US011761060B2

(12) United States Patent
Crudden

(10) Patent No.: US 11,761,060 B2
(45) Date of Patent: Sep. 19, 2023

(54) NICKEL-BASED ALLOY

(71) Applicant: ALLOYED LIMITED, Yarnton Kidlington (GB)

(72) Inventor: David Crudden, Yarnton (GB)

(73) Assignee: ALLOYED LIMITED, Kidlington (GB)

( * ) Notice: Subject to any disclaimer, the term of this patent is extended or adjusted under 35 U.S.C. 154(b) by 196 days.

(21) Appl. No.: 17/299,879

(22) PCT Filed: Dec. 4, 2019

(86) PCT No.: PCT/GB2019/053425
§ 371 (c)(1),
(2) Date: Jun. 4, 2021

(87) PCT Pub. No.: WO2020/115478
PCT Pub. Date: Jun. 11, 2020

(65) Prior Publication Data

US 2022/0090233 A1 Mar. 24, 2022

(30) Foreign Application Priority Data

Dec. 4, 2018 (GB) ..... 1819780

(51) Int. Cl.
*C22C 19/05* (2006.01)

(52) U.S. Cl.
CPC ..... *C22C 19/057* (2013.01); *C22C 19/056* (2013.01)

(58) Field of Classification Search
CPC ..... C22C 19/056; C22C 19/057; C22F 1/10
See application file for complete search history.

(56) References Cited

U.S. PATENT DOCUMENTS

| | | | |
|---|---|---|---|
| 3,164,465 | A | 1/1965 | Thielemann |
| 3,293,030 | A | 12/1966 | Child et al. |
| 3,677,747 | A | 7/1972 | Lund et al. |
| 3,720,509 | A | 3/1973 | Danesi et al. |
| 6,632,299 | B1 | 10/2003 | Harris |
| 2004/0187973 | A1 | 9/2004 | Takahata et al. |
| 2013/0142637 | A1 | 6/2013 | Harris et al. |

FOREIGN PATENT DOCUMENTS

| | | | |
|---|---|---|---|
| CN | 104404308 | 3/2015 | |
| EP | 1462533 | 9/2004 | |
| EP | 2913418 | 9/2015 | |
| GB | 1013347 | 12/1965 | |
| GB | 1087051 | 10/1967 | |
| GB | 2063721 | 6/1981 | |
| GB | 2071695 | 9/1981 | |
| GB | 2268937 | * 1/1994 | ..... C22C 19/056 |
| GB | 2554879 | 4/2018 | |
| JP | S59059854 | 4/1984 | |
| JP | H09157777 | 6/1997 | |
| JP | 2002294374 | 10/2002 | |
| RU | 2070597 | 12/1996 | |
| RU | 1376588 | 6/1997 | |
| RU | 2130088 | 5/1999 | |
| RU | 2148100 | 4/2000 | |
| WO | WO 2017/006089 | 1/2017 | |
| WO | WO 2017/153573 | 9/2017 | |
| WO | WO 2018/069666 | 4/2018 | |
| WO | WO 2018/069672 | 4/2018 | |

OTHER PUBLICATIONS

International Search Report and Written Opinion issued in corresponding International application No. PCT/GB2019/053425, dated Feb. 4, 2020.
Search Report under Section 17(5) from the International Property Office of the United Kingdom issued in corresponding Application No. GB1819780.6, dated May 23, 2019.
Tom Sellers and Robbie Bennett, "Alloy Development for 'Turbo Applications", *EICF 29th International Conference Porto 2018*, Apr. 24, 2018.

* cited by examiner (Continued)

*Primary Examiner* — Jessee R Roe
(74) *Attorney, Agent, or Firm* — NORTON ROSE FULBRIGHT US LLP

(57) ABSTRACT

A nickel-based alloy composition consisting, in weight percent, of: between 5.0% and 6.9% aluminium, between 0.0% and 11.0% cobalt, between 6.0% and 11.6% chromium, between 0.0% and 4.0% molybdenum, between 0.0% and 2.0% niobium, between 0.6 and 8.6% tantalum, between 0.0% and 3.0% titanium, between 8.4% and 15.2% tungsten, between 0.02 wt. % and 0.35 wt. % carbon, between 0.001 and 0.2 wt. % boron, between 0.001 wt. % and 0.5 wt. %. zirconium, between 0.0 and 0.5% silicon, between 0.0 and 0.1% yttrium, between 0.0 and 0.1% lanthanum, between 0.0 and 0.1% cerium, between 0.0 and 0.003% sulphur, between 0.0 and 0.25% manganese, between 0.0 and 0.5% copper, between 0.0 and 2.0% hafnium, between 0.0 and 1.0% vanadium, between 0.0 and 4.0% iron, between 0.0 and 1.0% rhenium, the balance being nickel and incidental impurities, wherein the following equations are satisfied in which $W_{Nb}$, $W_{Ta}$, $W_{Ti}$, $W_{Cr}$, $W_{Mo}$, $W_{W}$ and $W_{Re}$ are the weight percent of niobium, tantalum, titanium, chromium, molybdenum, tungsten and rhenium in the alloy respectively $6.6 \leq 2W_{Ti}+W_{Ta}+1.44W_{Nb}$, $22.2 \geq W_{W}+W_{Re}+1.16\ W_{Cr}+1.7W_{Mo}$, $13.9 \leq W_{Mo}+1.17(W_{W}+3.3W_{Re})$.

19 Claims, 18 Drawing Sheets

NICKEL-BASED ALLOY

This application is a national phase application under 35 U.S.C. § 371 of International Application No. PCT/GB2019/053425, filed Dec. 4, 2019, which claims priority to and the benefit of United Kingdom Application No. 1819780.6, filed Dec. 4, 2018. The contents of the referenced patent applications are incorporated into the present application by reference.

The present invention relates to a low cost cast nickel-based superalloy composition for used for high temperature applications. Typically improved high temperature capability in these alloys has been realised though the addition of elements which are rare and expensive, for example elements including rhenium, ruthenium and tantalum. There is a constant demand to improve the temperature capability of these alloys as it will result in higher performance in turbomachinery applications including but not limited to, gas turbines, jet propulsion and turbocharging of combustion engines. However, the excessive use of these rare and expensive elements in some alloys which have been developed has limited their commercial applicability because of the cost of material, uncertainty of long term price fluctuations and also uncertainty of continued supply of these so-called 'strategic elements'. The present invention describes a cast nickel based superalloy which had been designed to deliver significant cost reduction combined with exceptional high temperature performance particularly in terms of strength ad creep resistance. These desirable characteristics are combined with a high level of oxidation resistance, good microstructural stability and ability to manufacture.

Examples of typical compositions of cast nickel-based superalloys which are used for high temperature applications are listed in Table 1. The alloy IN713C is typically used in applications where operation temperature ranges between 900-950° C.; beyond this temperature the tensile strength and creep resistance of this alloy is insufficient. Typically, for temperatures 950° C.-1050° C. it is necessary to use the Mar-M246 and Mar-M247 alloys, as they have better high temperature strength and creep resistance than IN713C. For applications beyond 1050° C. the alloy CM681LC can be used. However this alloy has a high cost relative to the IN713C, Mar-M246 and Mar-M247 alloys, this cost may make it uneconomic for some applications where low cost is important, for example in the case of turbochargers for automotive applications. Thus, the aim of the present invention is to achieve high temperature performance which is better than Mar-M246 and Mar-M247, approaching the high temperature performance of CM681LC with a limited amount of cost increase. In particular a high level of creep performance is achieved in combination with a reduction in alloy cost while maintaining other key material properties including oxidation/corrosion resistance, microstructural stability and alloy density. The balance of properties for the new alloy make it suitable for many high temperature turbomachinery applications.

TABLE 1

Nominal composition in wt. % of conventionally cast nickel-based superalloys used commonly used for high temperature applications.

| Alloy (wt. %) | Al | Co | Cr | Mo | Nb | Ta | Ti | W | Re | C | B | Zr | Hf |
|---|---|---|---|---|---|---|---|---|---|---|---|---|---|
| IN713C | 6.0 | 0.0 | 13.5 | 4.5 | 2.0 | 0.0 | 0.8 | 0.0 | 0.0 | 0.10 | 0.01 | 0.06 | 0.00 |
| Mar-M246 | 5.5 | 10.0 | 9.0 | 2.5 | 0.0 | 1.5 | 1.5 | 10.0 | 0.0 | 0.15 | 0.01 | 0.05 | 0.00 |
| Mar-M247 | 5.5 | 10.0 | 8.2 | 0.6 | 0.0 | 3.0 | 1.0 | 10.0 | 0.0 | 0.16 | 0.015 | 0.05 | 1.50 |
| CM681LC | 5.7 | 9.3 | 5.5 | 0.6 | 0.0 | 6.1 | 0.15 | 8.4 | 3.0 | 0.11 | 0.018 | 0.013 | 1.50 |

The present invention provides a nickel-based alloy composition consisting, in weight percent, of: between 5.0% and 6.9% aluminium, between 0.0% and 11.0% cobalt, between 6.0% and 11.6% chromium, between 0.0% and 4.0% molybdenum, between 0.0% and 2.0% niobium, between 0.6 and 8.6% tantalum, between 0.0% and 3.0% titanium, between 8.4% and 15.2% tungsten, between 0.02 wt. % and 0.35 wt. % carbon, between 0.001 and 0.2 wt. % boron, between 0.001 wt. % and 0.5 wt. %. zirconium, between 0.0 and 0.5% silicon, between 0.0 and 0.1% yttrium, between 0.0 and 0.1% lanthanum, between 0.0 and 0.1% cerium, between 0.0 and 0.003% sulphur, between 0.0 and 0.25% manganese, between 0.0 and 0.5% copper, between 0.0 and 2.0% hafnium, between 0.0 and 1.0% vanadium, between 0.0 and 4.0% iron, between 0.0 and 1.0% rhenium, the balance being nickel and incidental impurities, wherein the following equations are satisfied in which $W_{Nb}$, $W_{Ta}$, $W_{Ti}$, $W_{Cr}$, $W_{Mo}$, $W_{W}$ and $W_{Re}$ are the weight percent of niobium, tantalum, titanium, chromium, molybdenum, tungsten and rhenium in the alloy respectively $$6.6 \leq 2W_{Ti}+W_{Ta}+1.44W_{Nb}$$

$$22.2 \geq W_{W}+W_{Re}+1.16W_{Cr}+1.7W_{Mo}$$

$$13.9 \leq W_{Mo}+1.17(W_{W}+3.3W_{Re})$$

Such an alloy displays high temperature performance in terms of strength and creep resistance comparable to CM681LC at a lower cost and with acceptable structural stability. Preferably the nickel-based alloy composition satisfies the following equation in which $W_{Al}$, $W_{Ti}$ $W_{Nb}$ and $W_{Ta}$ are the weight percent of aluminium, titanium, niobium and tantalum in the alloy respectively $$6.5 \leq W_{Al}+0.5W_{Ti}+0.3W_{Nb}+0.15W_{Ta} \leq 6.9$$

Such an alloy has an optimal volume fraction of gamma prime.

Preferably the nickel-based alloy composition satisfies the following equation in which $W_{Ti}$, $W_{Ta}$ and $W_{Nb}$ are the weight percent of titanium, tantalum and niobium in the alloy respectively $$7.4 \leq 2W_{Ti}+W_{Ta}+1.44W_{Nb}$$

preferably $$8.2 \leq 2W_{Ti}+W_{Ta}+1.44W_{Nb}$$

Such an alloy is optimised for strength.

Preferably the nickel-based alloy composition consists of, in weight percent, of 7.0% or more chromium, preferably 7.5% or more chromium. Such an alloy has even better oxidation/corrosion resistance.

Preferably the nickel-based alloy composition consists of, in weight percent, of 10.4% or less chromium, preferably 8.8% or less chromium, more preferably 7.7% or less chromium. Such an alloy has further improved microstructural stability.

Preferably the nickel-based alloy composition consists of, in weight percent, of 1.4 wt % or more tantalum, preferably 2.5 wt % or more tantalum, more preferably 2.6 wt % or more tantalum, even more preferably 3.5 wt % or more tantalum, yet more preferably 5.5% or more tantalum, most preferably 7.7% or more tantalum. Such an alloy has improved strength.

Preferably the nickel-based alloy composition consists of, in weight percent, of 4.0% or less molybdenum, preferably 3.3% or less molybdenum, more preferably 3.0% or less molybdenum, even more preferably 2.0% or less molybdenum, most preferably 1.0% or less molybdenum. Such an alloy has an improved balance of creep and oxidation resistance.

Preferably the nickel-based alloy composition consists of, in weight percent, of 2.85% or less titanium, preferably 2.0% or less titanium, more preferably 1.55% or less titanium. Such an alloy achieves good strength whilst also achieving the desired level of gamma prime.

Preferably the nickel-based alloy composition consists of, in weight percent, of 0.1 wt % or more hafnium and/or of 1.5% or less hafnium, preferably 1.0% or less hafnium. Such an alloy has a suitable amount of additional grain boundary strengthening.

Preferably the nickel-based alloy composition consists of, in weight percent, of 14.0 wt. % or less tungsten, preferably 13.1 wt % or less tungsten as this improves alloy microstructural stability.

Preferably the nickel-based alloy composition consists of, in weight percent, of 9.3% or more tungsten, preferably 10.6% or more tungsten, more preferably 11.1 wt. % or more tungsten. Such an alloy has improved creep resistance.

Preferably the nickel-based alloy composition consists, in weight percent, of 7.3% or less tantalum, preferably of 6.8% or less tantalum, more preferably of 6.1% or less tantalum. Such an alloy has improved oxidation resistance.

Preferably the nickel-based alloy composition consists, in weight percent, of 5.4% or more aluminium, preferably of 5.5% or more aluminium, more preferably of 5.7% or more aluminium. Such an alloy has improved high temperature strength and oxidation resistance.

Preferably the nickel-based alloy composition consists of, in weight percent, of 1.0% or more iron. Such an alloy is easier to produce from recycles materials.

Preferably the nickel-based alloy composition consists of, in weight percent, of 2.0% or less iron. Such an alloy has reduced propensity to form unwanted Lavers phase.

Preferably the nickel-based alloy composition according to any of claims 1 to 17, wherein the following equation is satisfied in which $W_{Ta}$ and $W_W$ are the weight percent of tantalum and tungsten in the alloy respectively: $W_{Ta}+0.9W_W \leq 16.2$, preferably $W_{Ta}+0.9W_W \leq 14.7$, more preferably $W_{Ta}+0.9W_W \leq 13.4$. Such an alloy has a lower density.

Preferably the nickel-based alloy composition satisfies the following equation in which $W_{Mo}$, $W_W$, $W_{Cr}$ and $W_{Re}$ are the weight percent of molybdenum, tungsten, chromium and rhenium in the alloy respectively $$21.0 \geq W_W + W_{Re} + 1.16W_{Cr} + 1.7W_{Mo}$$

Such an alloy has improved stability.

Preferably the nickel-based alloy composition has between 60% and 65% volume fraction γ'. This is the volume fraction of gamma prime giving the best combination of physical properties.

Preferably the nickel based alloy composition has 1.0 wt % or less niobium. Such an alloy has improved castability and oxidation resistance.

Preferably the nickel based alloy composition has 0.35 wt % or more titanium, preferably 0.55% or more titanium, more preferably 0.95% or more titanium. This results in a stronger alloy.

Preferably the nickel based alloy composition has 5.1 wt % or more cobalt, preferably 7.5% or more cobalt. Such an alloy has a reduced gamma prime solvus.

Preferably the nickel based alloy composition has 10.2 wt % or less cobalt, preferably 9.6% or less cobalt. Such an alloy has a lowered freezing range.

Preferably the nickel based alloy has 1.1 wt % or more molybdenum, preferably 1.3 wt % or more molybdenum. Such an alloy has an improved balance between creep, density and cost.

The term "consisting of" is used herein to indicate that 100% of the composition is being referred to and the presence of additional components is excluded so that percentages add up to 100%. Unless otherwise stated, percents are expressed in weight percent.

The invention will be more fully described, by way of example only, with reference to the accompanying drawings in which.

Figure 1:
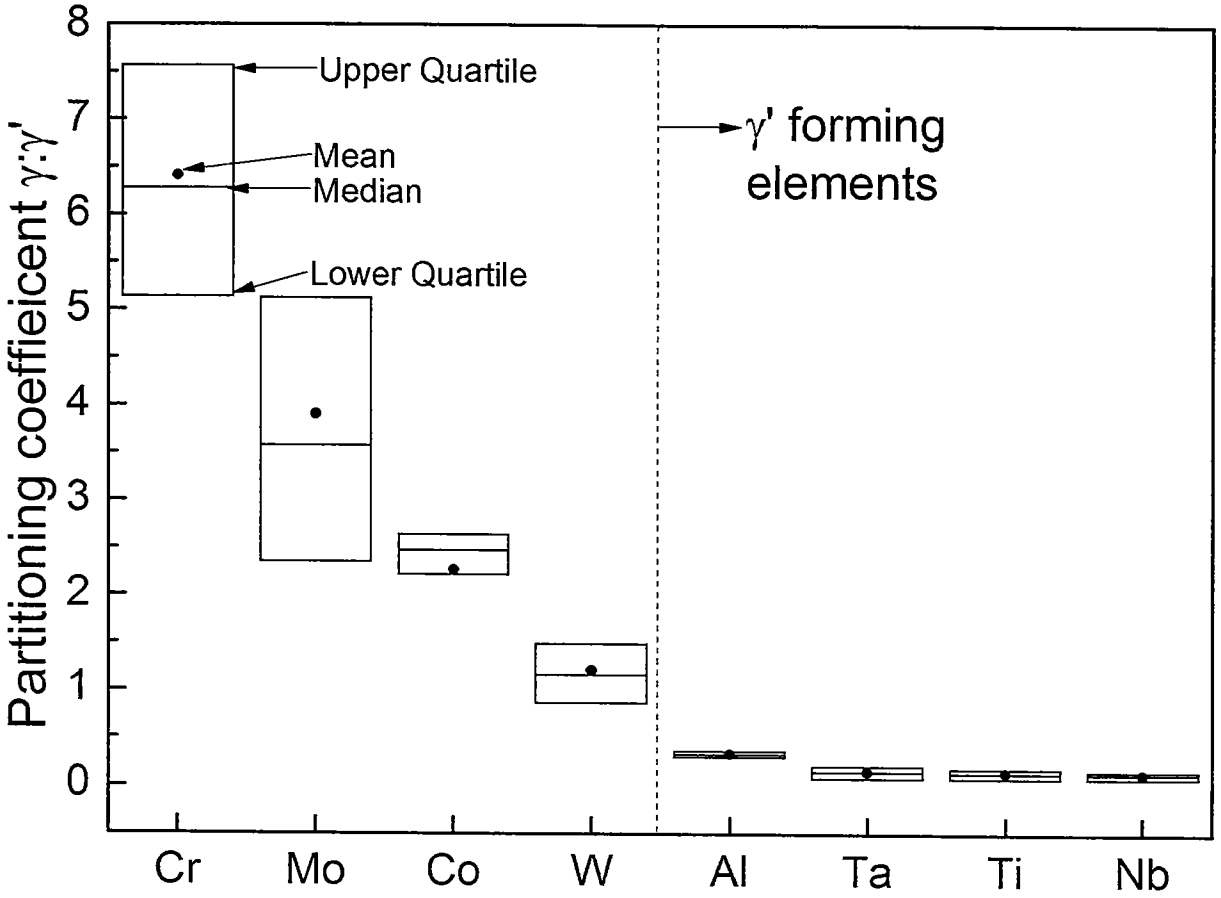
FIG. 1 shows the partitioning coefficient for the main components in the alloy design space.

Traditionally, nickel-based superalloys have been designed through empiricism. Thus their chemical compositions have been isolated using time consuming and expensive experimental development, involving small-scale processing of limited quantities of material and subsequent characterisation of their behaviour. The alloy composition adopted is then the one found to display the best, or most desirable, combination of properties. The large number of possible alloying elements indicates that these alloys are not entirely optimised and that improved alloys are likely to exist.

In superalloys, generally additions of chromium (Cr) and aluminium (Al) are added to impart resistance to oxidation/corrosion, cobalt (Co) is added to improve resistance to sulphidisation. For creep resistance, molybdenum (Mo), tungsten (W), cobalt are introduced, because these retard the thermally-activated processes—such as, dislocation climb—which determine the rate of creep deformation. To promote static and cyclic strength, aluminium (Al), tantalum (Ta), niobium (Nb) and titanium (Ti) are introduced as these promote the formation of the precipitate hardening phase gamma-prime (γ'). This precipitate phase is coherent with the face-centered cubic (FCC) matrix phase which is referred to as gamma (γ).

A modelling-based approach used for the isolation of new grades of nickel-based superalloys is described here, termed the "Alloys-By-Design" (ABD) method. This approach utilises a framework of computational materials models to estimate design relevant properties across a very broad compositional space. In principle, this alloy design tool allows the so called inverse problem to be solved; identifying optimum alloy compositions that best satisfy a specified set of design constraints.

The first step in the design process is the definition of an elemental list along with the associated upper and lower compositional limits. The compositional limits for each of the elemental additions considered in this invention referred to as the "alloy design space"—are detailed in Table 2.

TABLE 2

Alloys design space in wt. % searched using the "Alloys-by-Design" method.

| Alloy (wt. %) | Al | Co | Cr | Mo | Nb | Ta | Ti | W |
|---|---|---|---|---|---|---|---|---|
| Min | 4.0 | 0.0 | 4.0 | 0.0 | 0.0 | 0.0 | 0.0 | 0.0 |
| Max | 8.0 | 25.0 | 14.0 | 8.0 | 4.0 | 14.0 | 4.0 | 16.0 |

The balance is nickel. The levels of carbon, boron and zirconium where fixed at 0.06%, 0.015% and 0.06% respectively.

The second step relies upon thermodynamic calculations used to calculate the phase diagram and thermodynamic properties for a specific alloy composition. Often this is referred to as the CALPHAD method (CALculate PHAse Diagram). These calculations are conducted at the typical service temperature for the new alloy (900° C.), providing information about the phase equilibrium (microstructure).

A third stage involves isolating alloy compositions which have the desired microstructural architecture. In the case of nickel based superalloys which require superior resistance to creep deformation, the creep rupture life generally improves as the volume fraction of the precipitate hardening phase γ' is increased, the most beneficial range for volume fraction of γ' lies between 60%-70%. At values above 70% volume fraction of γ' a drop in creep resistance is observed.

It is also necessary that the γ/γ' lattice misfit should conform to a small value, either positive or negative, since coherency is otherwise lost; thus limits are placed on its magnitude. The lattice misfit δ is defined as the mismatch between γ and γ' phases, and is determined according to $$\delta = \frac{2(a_{\gamma'} - a_{\gamma})}{a_{\gamma'} + a_{\gamma}} \quad (1)$$

where $a_{\gamma}$ and $a_{\gamma'}$ are the lattice parameters of the γ and γ' phases.

Rejection of alloy on the basis of unsuitable microstructural architecture is also made from estimates of susceptibility to topologically close-packed (TCP) phases. The present calculations predict the formation of the deleterious TCP phases sigma (σ), P and mu (μ) using CALPHAD modelling.

Thus the model isolates all compositions in the design space which are calculated to result in a desired volume fraction of γ', which have a lattice misfit γ' of less than a predetermined magnitude and have a total volume fraction of TCP phases below a predetermined magnitude.

In the fourth stage, merit indices are estimated for the remaining isolated alloy compositions in the dataset. Examples of these include: creep-merit index (which describes an alloy's creep resistance based solely on mean composition), strength-merit index (which describes an alloy's precipitation yield strength based solely on mean composition), solid-solution merit index (which describes an alloy's solid solution yield strength based solely on mean composition), density and cost.

In the fifth stage, the calculated merit indices are compared with limits for required behaviour, these design constraints are considered to be the boundary conditions to the problem. All compositions which do not fulfil the boundary conditions are excluded. At this stage, the trial dataset will be reduced in size quite markedly.

The final, sixth stage involves analysing the dataset of remaining compositions. This can be done in various ways. One can sort through the database for alloys which exhibit maximal values of the merit indices—the lightest, the most creep resistant, the most oxidation resistant, and the cheapest for example. Or alternatively, one can use the database to determine the relative trade-offs in performance which arise from different combination of properties.

The example five merit indicies are now described.

The first merit index is the creep-merit index. The overarching observation is that time-dependent deformation (i.e. creep) of a nickel-based superalloy occurs by dislocation creep with the initial activity being restricted to the γ phase. Thus, because the fraction of the γ' phase is large, dislocation segments rapidly become pinned at the γ/γ' interfaces. The rate-controlling step is then the escape of trapped configurations of dislocations from γ/γ' interfaces, and it is the dependence of this on local chemistry in this case composition of they phase which gives rise to a significant influence of alloy composition on creep properties.

A physically-based microstructure model can be invoked for the rate of accumulation of creep strain e when loading is uniaxial and along the ⟨001⟩ crystallographic direction. The equation set is $$\dot{\varepsilon}_{\langle 001\rangle} = \frac{16}{\sqrt{6}}\rho_m\phi_p D_{eff}(1-\phi_p)\left(1/\phi_p^{1/3}-1\right)\sinh\left\{\frac{\sigma b^2\omega}{\sqrt{6}\,K_{CF}kT}\right\} \quad (2)$$

$$\dot{\rho}_m = C\dot{\varepsilon}_{\langle 001\rangle} \quad (3)$$

where $\rho_m$ is the mobile dislocation density, $\phi_p$ is the volume fraction of the γ' phase, and ω is width of the matrix channels. The terms σ and T are the applied stress and temperature, respectively. The terms b and k are the Burgers vector and Boltzmann constant, respectively. The term $K_{CF}=1+2\phi_p^{1/3}/3\sqrt{3\pi}(1-\phi_p^{1/3})$ is a constraint factor, which accounts for the close proximity of the cuboidal particles in these alloys. Equation 3 describes the dislocation multiplication process which needs an estimate of the multiplication parameter C and the initial dislocation density. The term $D_{eff}$ is the effective diffusivity controlling the climb processes at the particle/matrix interfaces.

Note that in the above, the composition dependence arises from the two terms $\phi_p$ and $D_{eff}$. Thus, provided that the microstructural architecture is assumed constant (microstructural architecture is mostly controlled by heat treatment) so that $\phi_p$ is fixed, any dependence upon chemical composition arises through $D_{eff}$. For the purposes of the alloy design modelling described here, it turns out to be unnecessary to implement a full integration of Equations 2 and 3 for each prototype alloy composition. Instead, a first order merit index $M_{creep}$ is employed which needs to be maximised, which is given by $$M_{creep} = \sum_i x_i/\tilde{D}_i \quad (4)$$

where $x_i$ is the atomic fraction of solute i in the γ phase and $\tilde{D}_i$ is the appropriate interdiffusion coefficient.

The second merit index is for strength merit index. For high nickel-based superalloys, the vast majority of strength comes from the precipitate phase. Therefore, optimising alloy composition for maximal precipitate strengthening is a critical design consideration. From hardening theory a merit index for strength, $M_{strength}$, is proposed. The index considers the maximum possible precipitate strength determined to be the point where the transition from weakly coupled to strongly coupled dislocation shearing occurs which can be approximated using, $$M_{strength} = \overline{M}\cdot\frac{1}{2}\gamma_{APB}\phi_p^{1/2}/b \quad (5)$$

Where $\overline{M}$ is the Taylor factor, $\gamma_{APB}$ is the anti-phase boundary (APB) energy, $\phi_p$ is the volume fraction of the γ' phase and b is the Burgers vector.

From Equation 5 it is apparent that fault energies in the γ' phase for example, the anti-phase boundary APB energy have a significant influence on the deformation behaviour of nickel-based superalloys. Increasing the APB energy has been found to improve mechanical properties including, tensile strength and resistance to creep deformation. The APB energy was studied for a number of Ni—Al—X systems using density functional theory. From this work the effect of ternary elements on the APB energy of the γ' phase was calculated, linear superposition of the effect for each ternary addition was assumed when considering complex multicomponent systems, resulting in the following equation, $$\gamma_{APB}=195-1.7x_{Cr}-1.7x_{Mo}+4.6x_W+27.1x_{Ta}+21.4x_{Nb}+15x_{Ti} \quad (6)$$

where, $x_{Cr}$, $x_{Mo}$, $X_W$, $x_{Ta}$, $x_{Nb}$ and $x_{Ti}$ represent the concentrations, in atomic percent, of chromium, molybdenum, tungsten, tantalum, niobium and titanium in the γ' phase, respectively. The composition of the γ' phase is determined from phase equilibrium calculations.

The third merit index is density. The density, ρ, was calculated using a simple rule of mixtures and a correctional factor, where, $\rho_i$ is the density for a given element and $x_i$ is the atomic fraction of the alloy element.

$$\rho=1.05[\Sigma_i x_i\rho_i] \quad (7)$$

The fourth merit index was cost. In order to estimate the cost of each alloy a simple rule of mixtures was applied, where the weight fraction of the alloy element, $x_i$ was multiplied by the current (2016) raw material cost for the alloying element, $c_i$.

$$\text{Cost}=\Sigma_i x_i c_i \quad (8)$$

A fifth merit index is based upon rejection of candidate alloys on the basis of unsuitable microstructural architecture made on the basis of susceptibility to TCP phases. To do this use is made of the d-orbital energy levels of the alloying elements (referred as Md) to determine the total effective Md level according to $$\overline{M_d}=\Sigma_i x_i Md_i \quad (9)$$

where the $x_i$ represents the mole fraction of the element i in the alloy. Higher values of Md are indicative of higher probability of TCP formation.

The estimates assume that processing costs are identical for all alloys, i.e. that the product yield is not affected by composition.

The ABD method described above was used to isolate the inventive alloy composition. The design intent for this alloy was to optimise the composition of a conventionally cast nickel-based superalloy composition to achieve high temperature performance which is better than Mar-M246 and Mar-M247, approaching the high temperature performance of CM681LC with a reduction in alloy cost and an acceptable microstructural stability. In particular a high level of creep performance is achieved in combination with a reduction in alloy cost while maintaining other key material properties including oxidation/corrosion resistance, microstructural stability and alloy density.

The material properties determined using the ABD method for the typical compositions of conventionally cast nickel-based alloys, listed in Table 1, are listed in Table 3. The design of the new alloy was considered in relation to the predicted properties listed for these alloys.

The rationale for the design of the new alloy is now described.

TABLE 3

Calculated phase fractions and merit indices made with the "Alloys-by-Design" software. Results for nickel-based superalloys listed in Table 1.

| Alloy | γ' | Creep Merit Index ($m^{-2}s \times 10^{-15}$) | Density ($g/cm^3$) | Cost ($/kg) | γ/γ' Misfit (%) | Strength Merit Index (Mpa) | Md (eV) |
|---|---|---|---|---|---|---|---|
| IN713C | 0.54 | 2.89 | 8.0 | 16 | −0.40 | 1133 | 0.92 |
| Mar-M246 | 0.56 | 7.34 | 8.5 | 30 | −0.35 | 1246 | 0.93 |
| Mar-M247 | 0.58 | 7.52 | 8.6 | 50 | −0.16 | 1279 | 0.91 |
| CM681LC | 0.62 | 14.3 | 8.9 | 128 | −0.25 | 1396 | 0.91 |

Optimisation of the alloy's microstructure—primarily comprised of an austenitic face centre cubic (FCC) gamma phase (γ) and the ordered $L1_2$ precipitate phase (γ') was required to maximise creep resistance. In the case of nickel-based superalloys which require superior resistance to creep deformation, the creep rupture life generally improves as the volume fraction of the precipitate hardening phase γ' is increased. The most beneficial range for volume fraction of γ' lies between 60%-70%. At values above 70% volume fraction of γ' a drop in creep resistance is observed.

The partitioning coefficient for each element included in the alloy design space was determined from phase equilibrium calculations conducted at 900° C., FIG. 1. A partitioning coefficient of unity describes an element with equal preference to partition to the γ or γ' phase. A partitioning coefficient less than unity describes an element which has a preference for the γ' phase, the closer the value to zero the stronger the preference. The greater the value above unity the more an element prefers to reside within the γ phase. The partitioning coefficients for aluminium, tantalum, titanium and niobium show that these are strong γ' forming elements. The elements chromium, molybdenum, cobalt, and tungsten partition preferably to they phase. For the elements considered within the alloy design space aluminium, tantalum, titanium and niobium partition most strongly to the γ' phase. Hence, aluminium, tantalum, titanium and niobium levels were controlled to produce the desired γ' volume fraction.

FIGS. 2-6 show the effect which elements added to form the γ' phase predominantly aluminium, tantalum and titanium have on the fraction of γ' phase in the alloy at the equilibrium temperature of 900° C. in this instance, this temperature is representative of the normal operating temperature for such an alloy.

Figure 2:
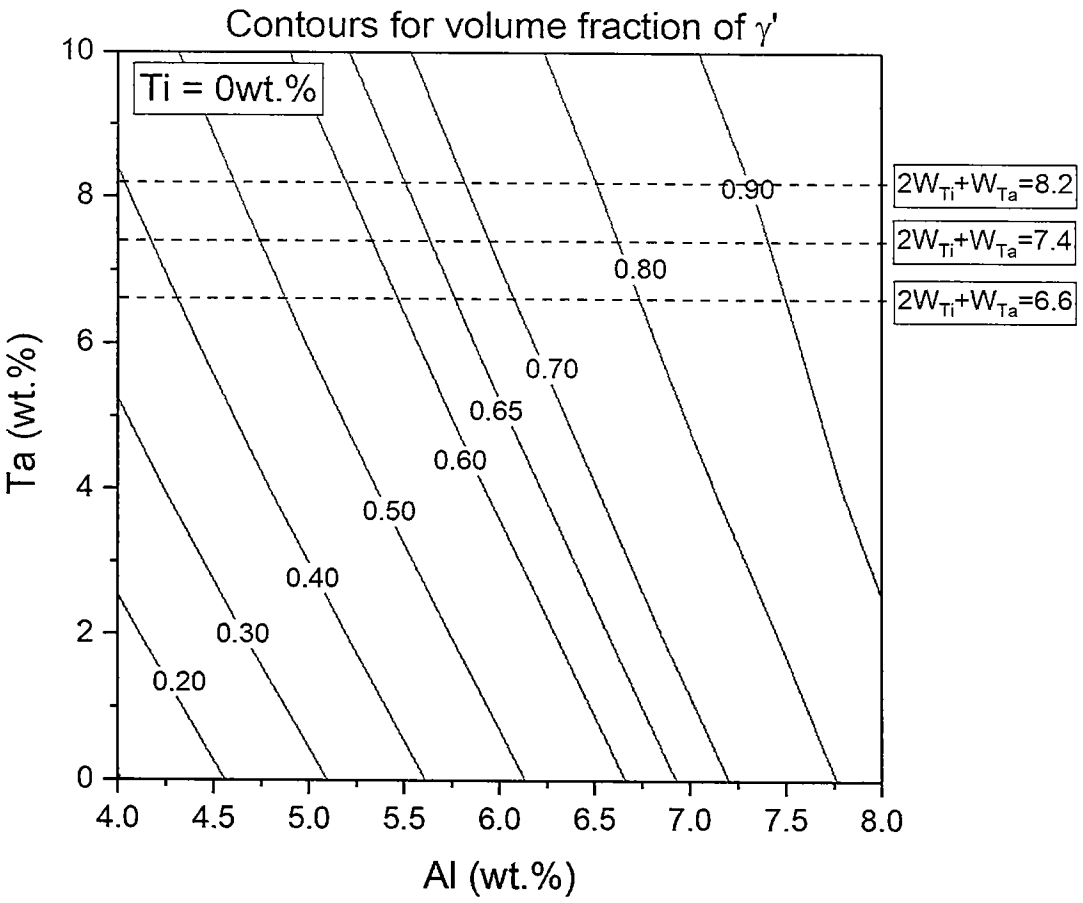
FIG. 2 is a contour plot showing the effect of γ' forming elements aluminium and tantalum on volume fraction of γ' when titanium content is fixed at 0.0 wt. % for alloys within the alloy design space, determined from phase equilibrium calculations conducted at 900° C.
Figure 3:
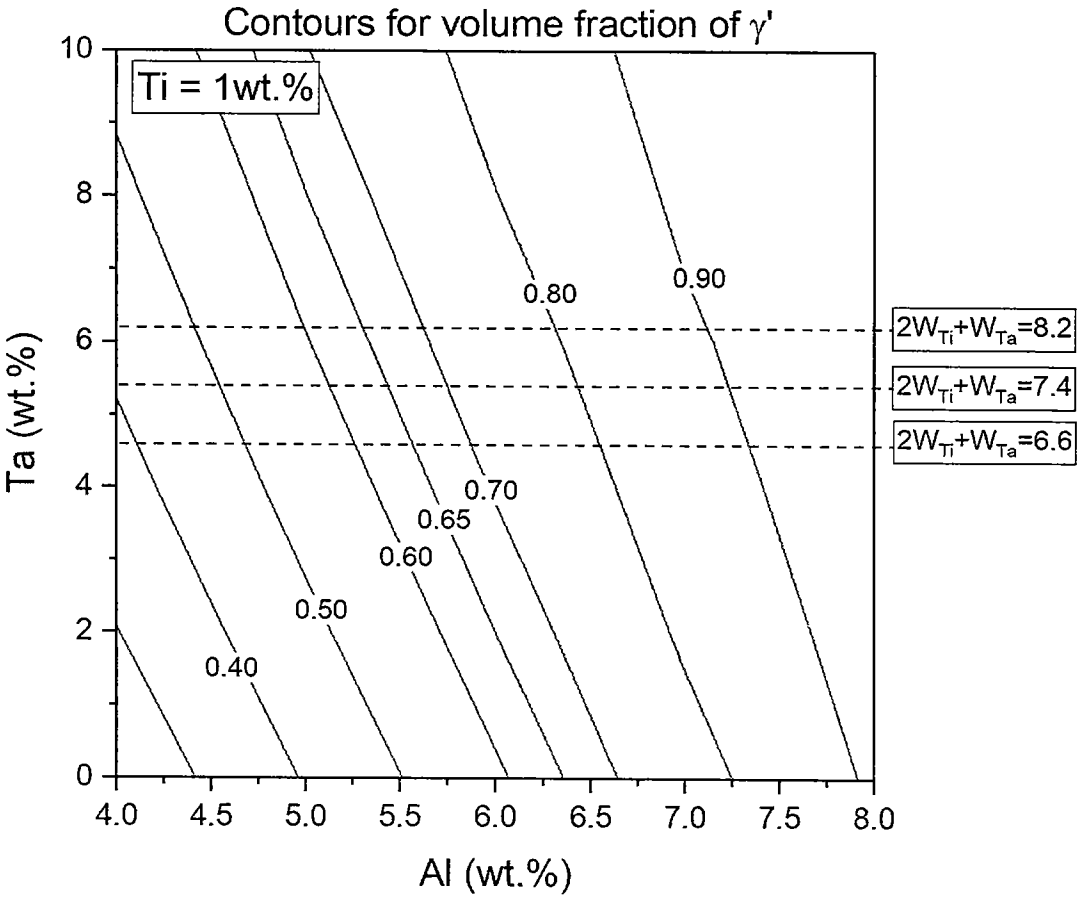
FIG. 3 is a contour plot showing the effect of γ' forming elements aluminium and tantalum on volume fraction of γ' when titanium content is fixed at 1.0 wt. % for alloys within the alloy design space, determined from phase equilibrium calculations conducted at 900° C.

For the design of this alloy a volume fraction of γ' between 60-65% was desired as the best balance of mechanical properties (creep resistance and tensile strength) and ability to manufacture by casting is achieved. Volume fractions of γ' less than 65% improve castability by reducing unwanted artefacts which may arise from the casting process including micro-segregation, casting porosity and fraction of γ/γ' eutectic phase, these unwanted artefacts lead to a degradation in material performance and increase the need for expensive post-processing of the alloy. However, at γ' volume fractions of less than 60% it is difficult to achieve an improvement in strength relative to Mar-M246 and Mar-M247 which have γ' fractions between 56% and 58% respectively. A volume fraction of γ' beyond 65%, in the range 65-70% may result in a very high strength but the ability to cast the alloy will be reduced and the need for expensive post-processing will be increased as the high γ' fraction can lead to a high level of casting porosity and a high γ/γ' eutectic fraction. Up to 6.9 weight percent (wt. %) of aluminium can be added to produce this volume fraction of γ' phase (FIG. 2).

The alloy should contain a minimum of 5.0 wt. % aluminium to impart resistance to oxidation during high temperature service. At temperatures beyond 900° C. a protective alumina scale ($Al_2O_3$) is desired to provide oxidation resistance. An alloy with aluminium content of 5.5 wt. % is preferred as oxidation resistance will be improved, a higher aluminium content promotes a more continuous oxide scale and also reduces the time required to form a protective oxide scale reducing the period where transient oxidation is occurring. More preferably a minimum aluminium content of 5.7 wt. % is desired as this further improves the resistance to oxidation.

From FIGS. 2-6 the change in γ' volume fraction was related to the sum of the elements aluminium, tantalum and titanium content according to the formula $$f(\gamma')=W_{Al}+0.5W_{Ti}+0.3W_{Nb}+0.15W_{Ta}$$

where, f(γ') is a numerical value which ranges between 6.5 and 6.9 for an alloy with the desired γ' fraction, between 60% and 65% in this case, and $W_{Ta}$, $W_{Ti}$, $W_{Nb}$ and $W_{Al}$ are the weight percent of the elements tantalum, titanium, niobium and aluminium in the alloy respectively.

Figure 10:
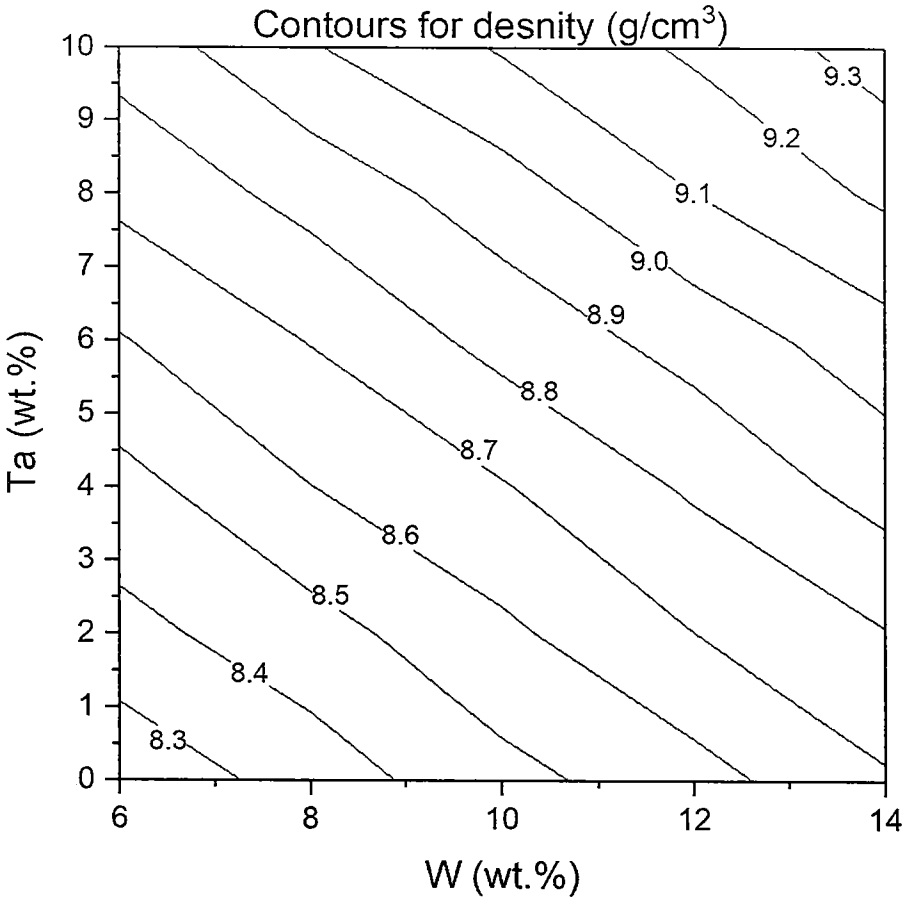
FIG. 10 is a contour plot showing the effect of elements tungsten and tantalum on alloy density for alloys with volume fraction of γ' between 60-65%.
Figure 11:
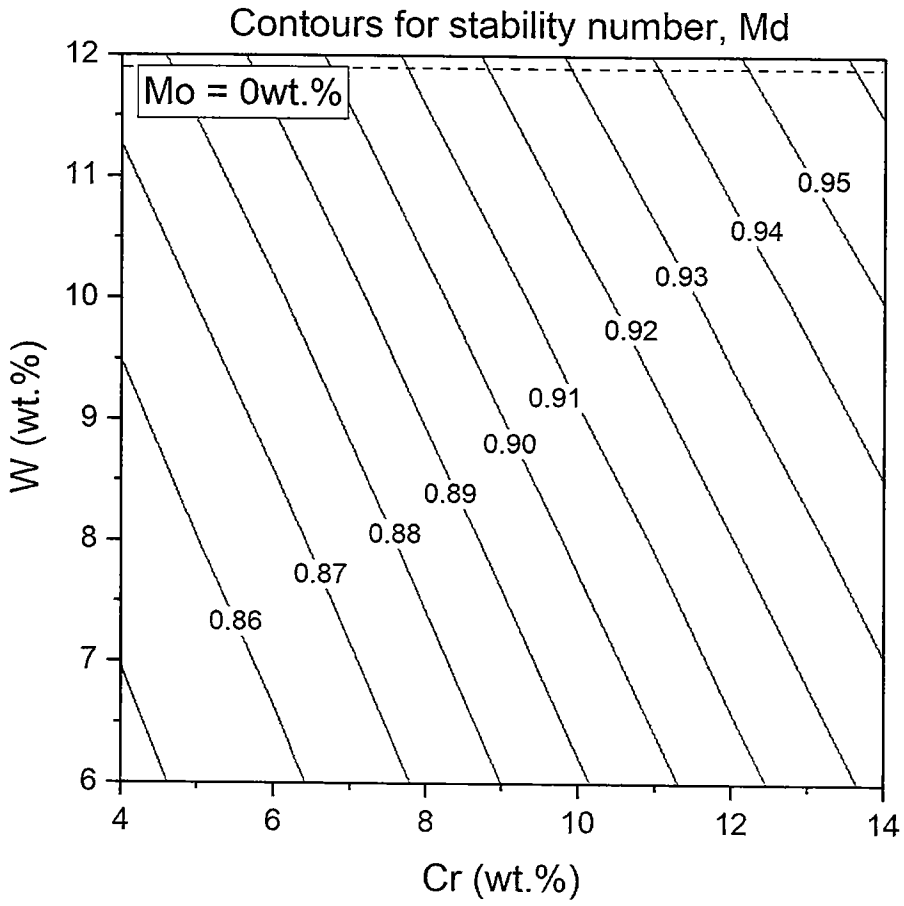
FIG. 11 is a contour plot showing the effect of element chromium and tungsten on all stability (in terms of Md number calculated at an equilibrium temperature of 750° C.) when molybdenum content is fixed at 0.0 wt. %.
Figure 12:
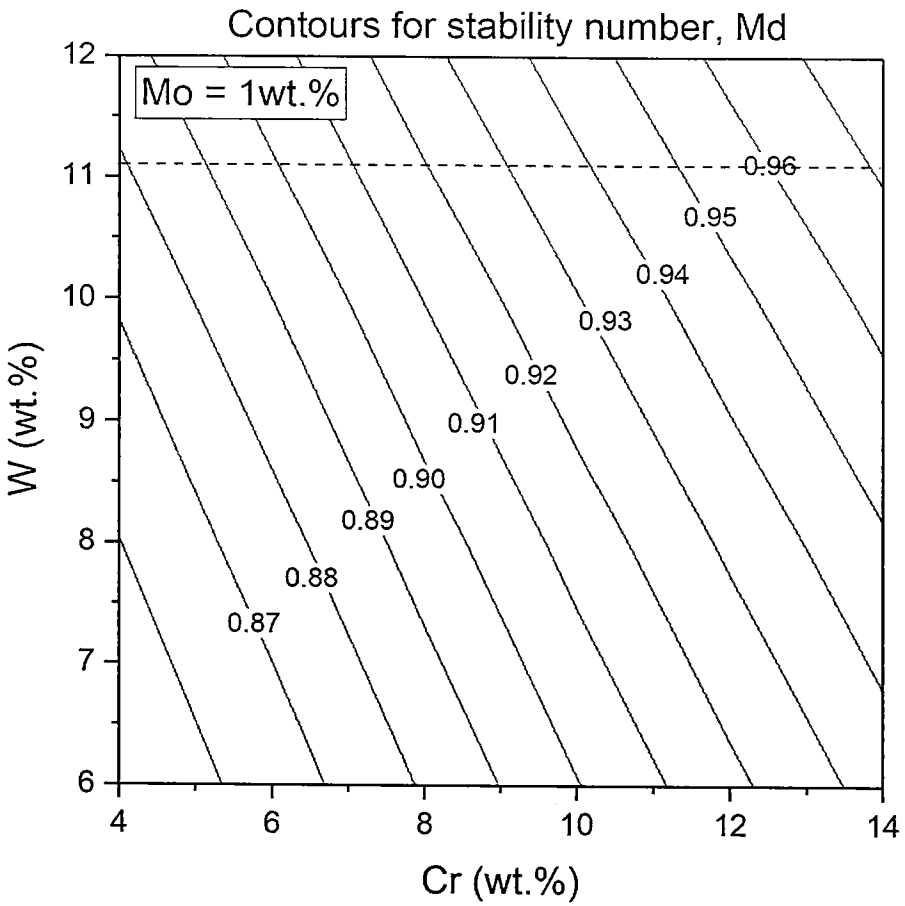
FIG. 12 is a contour plot showing the effect of element chromium and tungsten on all stability (in terms of Md number calculated at an equilibrium temperature of 750° C.) when molybdenum content is fixed at 1.0 wt. %.
Figure 13:
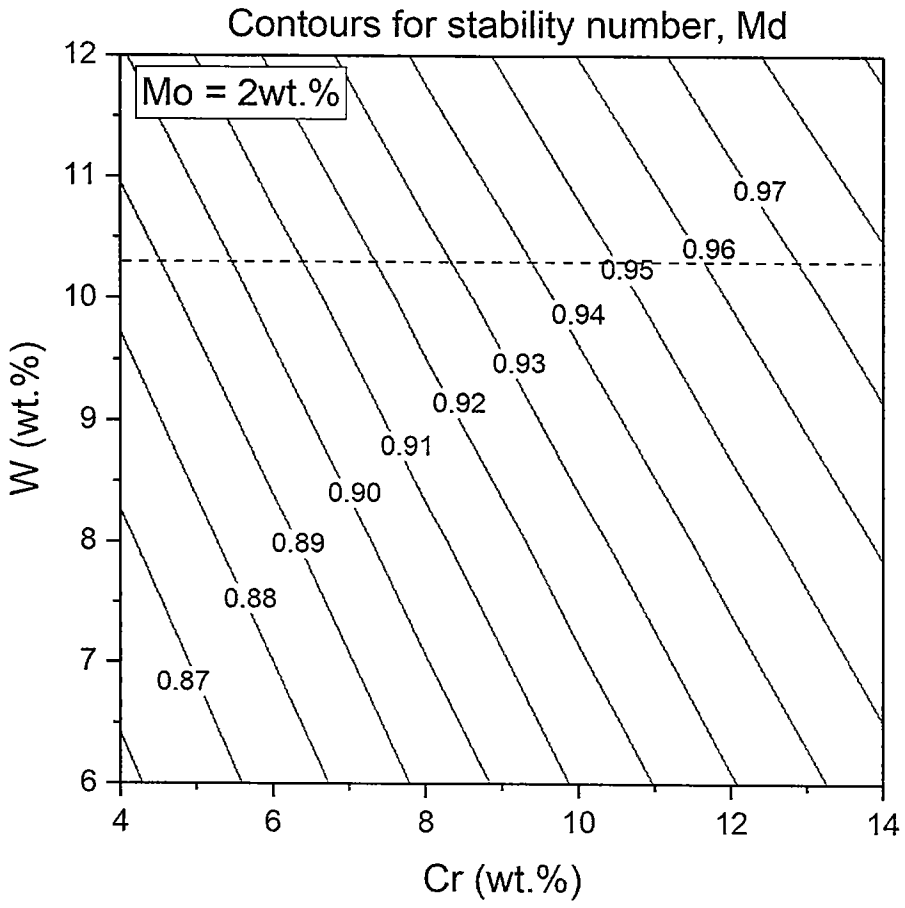
FIG. 13 is a contour plot showing the effect of element chromium and tungsten on all stability (in terms of Md number calculated at an equilibrium temperature of 750° C.) when molybdenum content is fixed at 2.0 wt. %.
Figure 14:
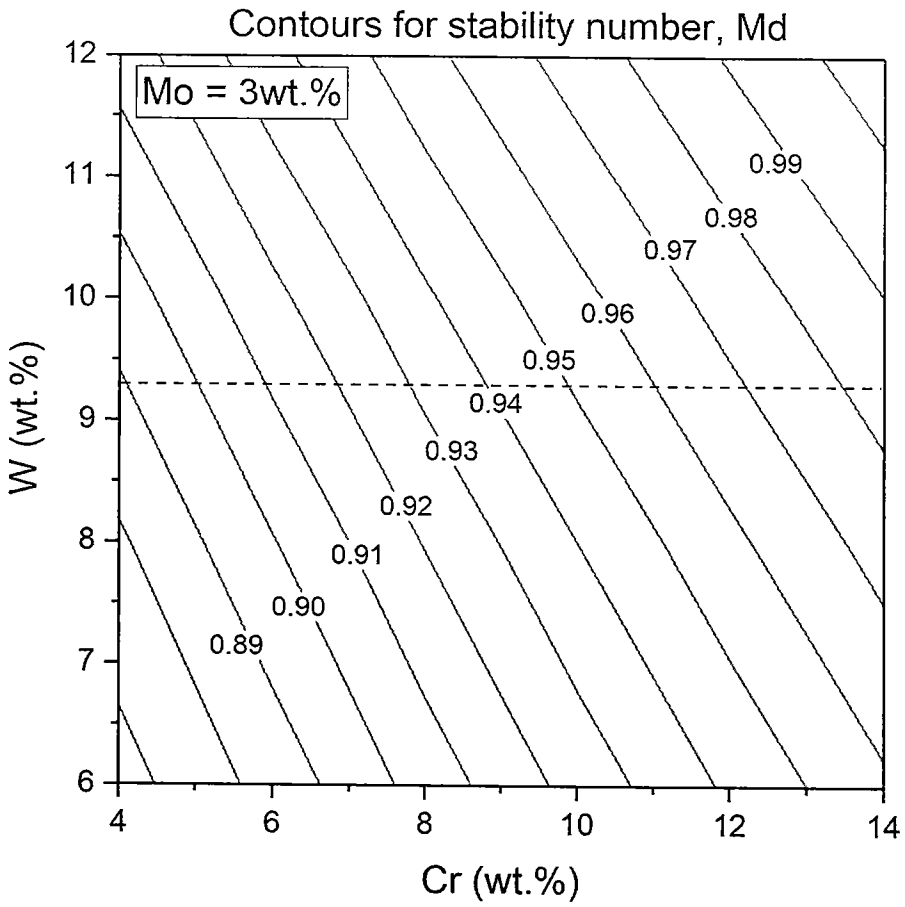
FIG. 14 is a contour plot showing the effect of element chromium and tungsten on all stability (in terms of Md number calculated at an equilibrium temperature of 750° C.) when molybdenum content is fixed at 3.0 wt. %.
Figure 15:
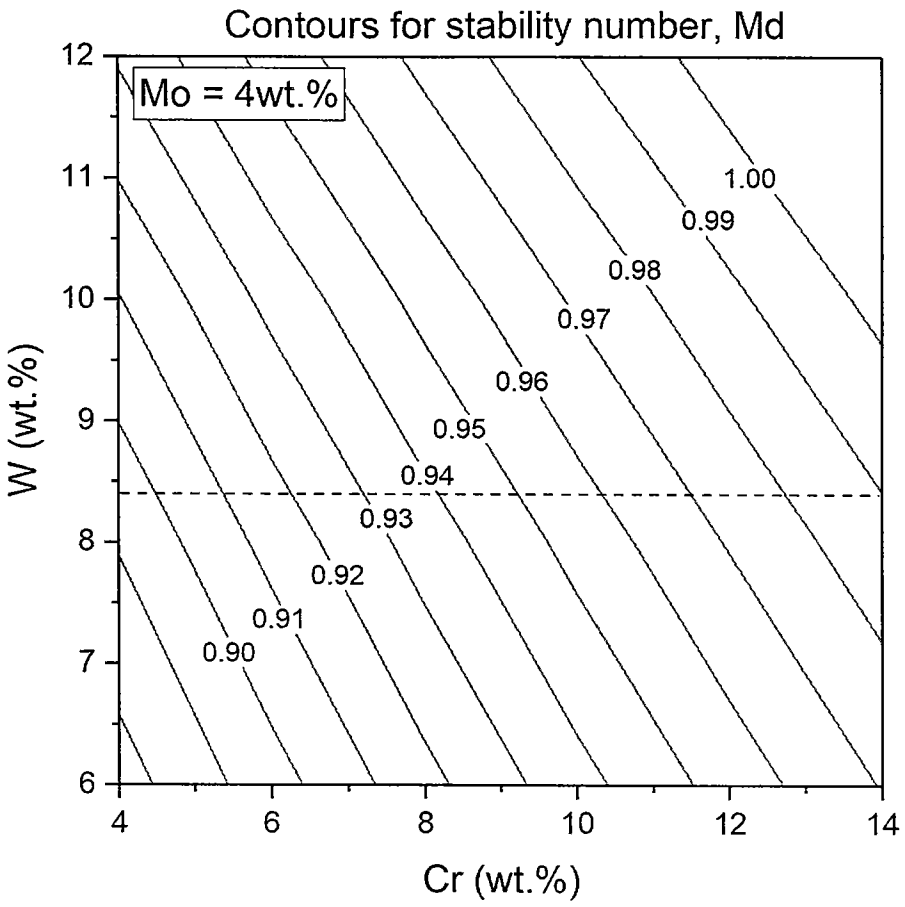
FIG. 15 is a contour plot showing the effect of element chromium and tungsten on all stability (in terms of Md number calculated at an equilibrium temperature of 750° C.) when molybdenum content is fixed at 4.0 wt. %.

The maximum level of tantalum (8.6%) is determined based on keeping the density of the alloy within reasonable limits. FIGS. 2-5 show that at such a level and with a minimum aluminium content of 5.0%, the desired gamma prime volume fraction can be achieved. Most preferably aluminium content is greater than or equal to 5.7 wt. % for improved oxidation resistance therefore it is preferred that tantalum is limited to 7.3 wt. % or less. Reductions in tantalum reduce density (FIG. 10) so that a preferred level of tantalum is 7.1 wt % or less, more preferably 6.8 wt. % or less and most preferably 6.1 wt. % or less.

Figure 4:
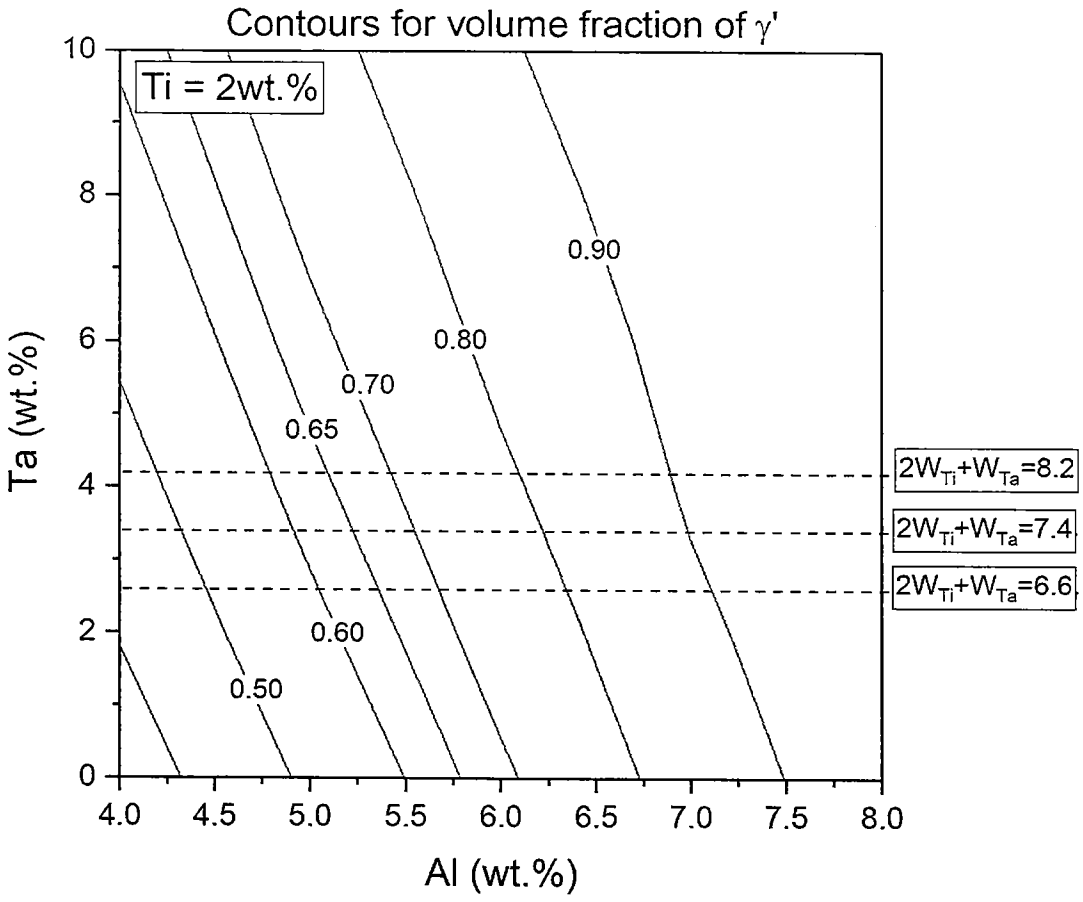
FIG. 4 is a contour plot showing the effect of γ' forming elements aluminium and tantalum on volume fraction of γ' when titanium content is fixed at 2.0 wt. % for alloys within the alloy design space, determined from phase equilibrium calculations conducted at 900° C.
Figure 5:
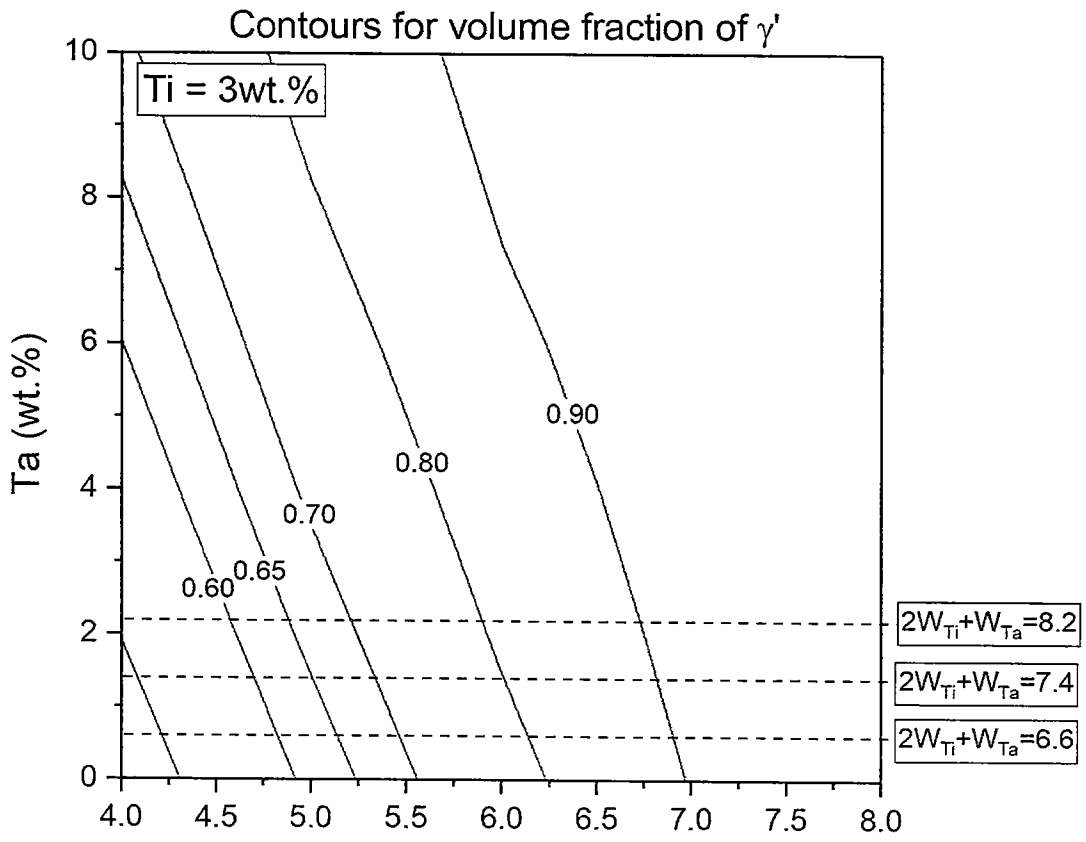
FIG. 5 is a contour plot showing the effect of γ' forming elements aluminium and tantalum on volume fraction of γ' when titanium content is fixed at 3.0 wt. % for alloys within the alloy design space, determined from phase equilibrium calculations conducted at 900° C.
Figure 6:
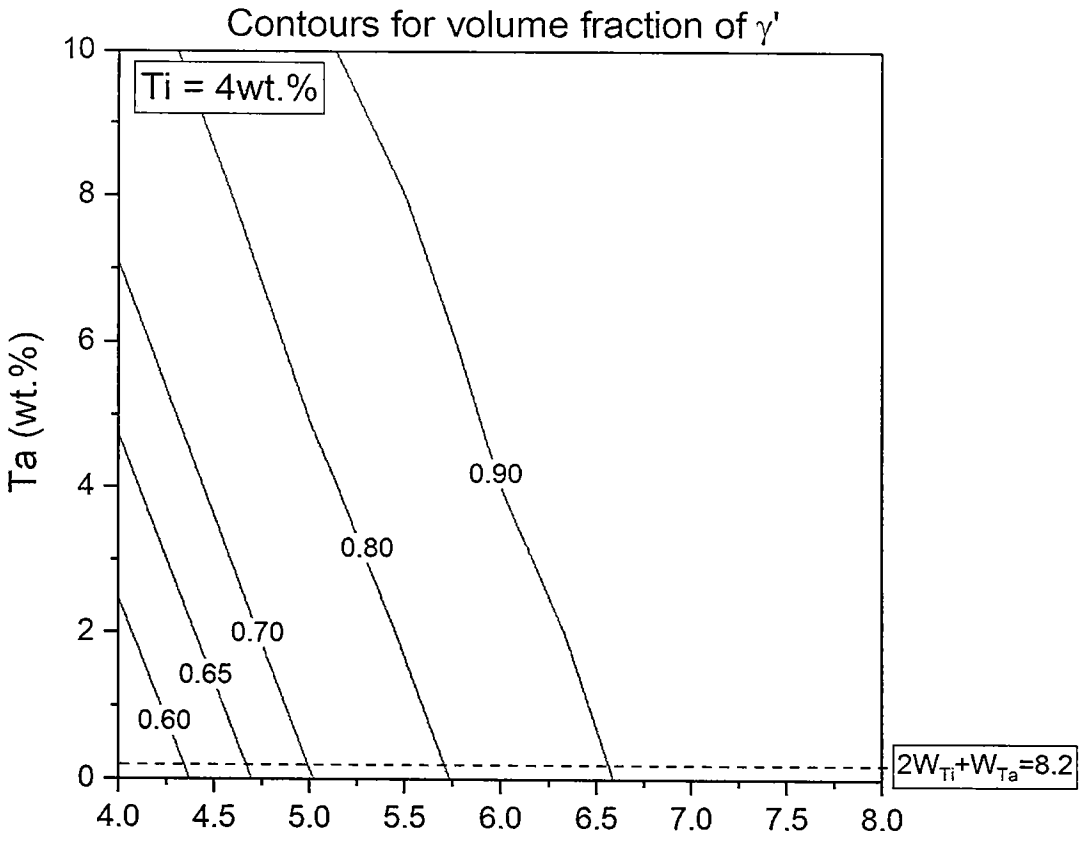
FIG. 6 is a contour plot showing the effect of γ' forming elements aluminium and tantalum on volume fraction of γ' when titanium content is fixed at 4.0 wt. % for alloys within the alloy design space, determined from phase equilibrium calculations conducted at 900° C.
Figure 7:
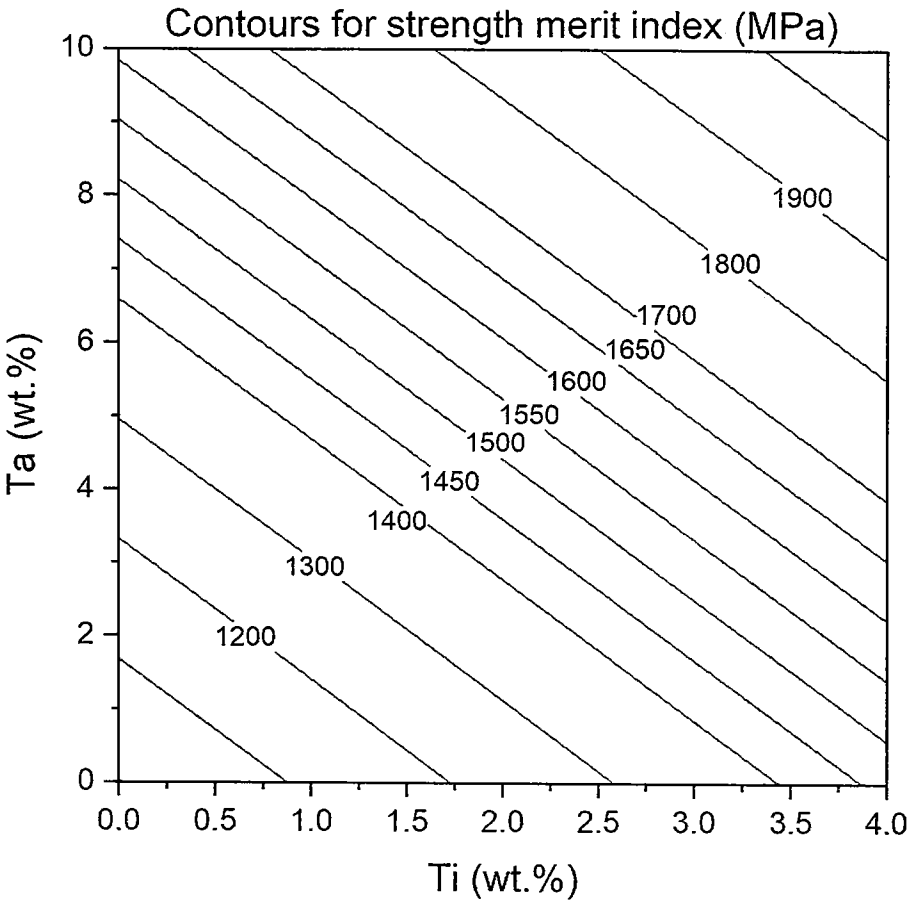
FIG. 7 is a contour plot showing the effect of γ' forming elements titanium and tantalum on strength merit index for alloys with volume fraction of γ' between 60-65%.

At the minimum aluminium level of 5.0 wt. % the titanium level in the alloy must be limited to 3.0 wt. % or less in order to achieve a γ' volume fraction between 60-65% (FIGS. 2-6) in combination with a desirable strength in terms of strength merit index, described in the following section with reference to (FIG. 7). To achieve the desired strength a minimum of 0.6 wt. % tantalum is required (FIG. 5). At a titanium level of 3.0 wt. % the maximum level of aluminium is desirably limited to 5.1 wt. %. Preferably, titanium is limited to 2.0 wt. % or less as this provides an improved combination of high temperature strength and oxidation resistance as an increased minimum level of aluminium of 5.4 wt. % can be included in the alloy. Desirably to achieve high strength, particularly when titanium is limited to 2.0 wt. %, a tantalum level of at least 2.6 wt. % is preferred (FIG. 4).

Niobium is also an element which forms the γ' phase in the alloy. Niobium can be added up to 2 wt. %, particularly in substitution for additions tantalum. Niobium can substitute for tantalum according to the following $W_{Ta}=0.52\ W_{Nb}$ (determined from the density of niobium 8.6 g/cm$^3$ relative to tantalum 16.4 g/cm$^3$). Niobium may substituted with tantalum to lower the cost of the alloy. Preferably niobium is limited to less than 1.0 wt. % as it reduces the oxidation resistance and castability of the alloy.

Tantalum and titanium are typically added to substitute for aluminium atoms in the γ' phase, such that the γ' phase is of composition $Ni_3(Al,Ti,Ta)$. The elements tantalum and titanium increase the anti-phase boundary (APB) energy of the γ' phase (Equation 6) having the technical effect of increasing the overall strengthening provided by the precipitate phase (Equation 5). Increasing the APB energy is beneficial for both tensile strength and creep resistance as the precipitate phase has an increased resistance to shear under stress.

FIG. 7 shows the calculated strength merit index for alloys which have between 60-65% γ' phase fraction. For the invention described a high strength merit index of 1400 MPa or greater is required. An index of 1400 MPa is desired to produce an alloy with equivalent tensile strength as CM681LC. This strength index provides an improvement in strength compared to Mar-M246 and Mar-M247 alloys, resulting in improved high temperature performance in comparison to these alloys. Preferably the strength merit index should be greater than 1450 MPa so that the yield stress is greater than all currently used alloy, even more preferably it should be greater than 1500 MPa.

Modelling calculation showed that for alloys with a volume fraction of γ' between 60-65% the strength merit index was related to the sum of the elements tantalum and titanium according to the formula $$f(\text{strength})=2W_{Ti}+W_{Ta}+1.44W_{Nb}$$

where, f(strength) is a numerical value which is greater than 6.6 for an alloy with the desired strength merit index, 1400 MPa in this case. Preferably a value of 7.4 is desired as this produces a stronger alloy with a merit index of 1450 MPa, most preferably value of 8.2 or greater is desired as this produces a strength merit index of 1500 MPa or greater. This equation includes a term for niobium as this can substitute for tantalum. However, the APB hardening provided by Niobium is less than tantalum (Equation 6). The factor 1.44 is obtained from the different densities (0.52) and the differing strengthening coefficient (Ta=27.1 and Nb=21.4). To replace tantalum on an atomic basis 0.52 of niobium is needed, however these atoms only have 0.75 of the strengthening effect, so 0.75*(1/0.52)=1.44.

Figure 8:
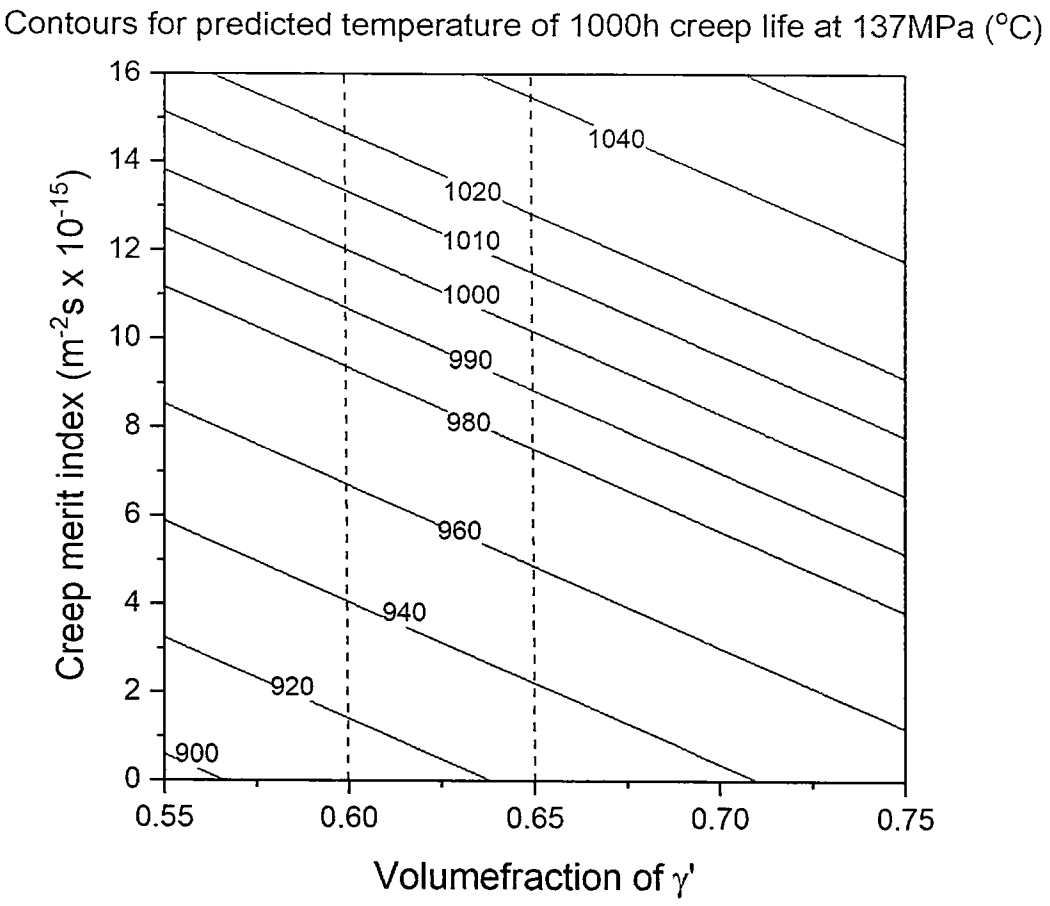
FIG. 8 is a contour plot showing the effect volume fraction of γ' and creep merit index on the predicted 1000 hour creep life at 137 MPa.

Based upon the maximum titanium level of 3.0 wt. % it is required that there is at least 0.6 wt. % of tantalum in the alloy to achieve a value for ((strength) of at least 6.6 assuming no niobium. Preferably tantalum is at least 1.4 wt. % to achieve a value for ((strength) of 7.4. It is difficult to achieve a γ' volume fraction between 60-65% combined with a value for f(strength) of 8.2 or greater when the titanium content is 3.0 wt. %. By considering the functions for both f(γ') and f(strength) it is determined that it is preferred that titanium is limited to 2.85 wt. % as it is possible to achieve a value for f(strength) of 8.2 with a volume fraction of γ' between 60-65%. It is preferred to have a tantalum content of greater than 2.5 wt. %. More preferably titanium is limited to 1.55 wt. % as an even better combination of oxidation resistance and strength arises from having at least 5.5 wt. % aluminium. In order to achieve the desired alloy strength particularly when titanium is limited to 1.55 wt. % at least 3.5 wt. % tantalum may be included in the alloy. Preferably to achieve a value for f(strength) of 7.4 at an aluminium content of 5.5 wt. % the titanium content is limited to 0.95 wt. %. A minimum content of 5.5 wt. % tantalum is desired. More preferably to achieve a value or f(strength) of 8.2 at an aluminium content of 5.5 wt. % the titanium content is limited to 0.35 wt. %, therefore a minimum content of 7.7 wt. % tantalum is desired. Even more preferably titanium is limited to 0.55 wt. % as an even better combination of oxidation resistance and strength arises from having at least 5.7 wt. % aluminium. In order to achieve high strength when titanium is limited to 0.55 wt. % at least 5.5 wt. % tantalum is preferred. As previously described the yield stress and creep resistance of the alloy is increased by controlling the γ' volume fraction and strength merit index. For the alloys which satisfied the previously described requirements it was necessary to optimise the levels of refractory elements for maximum creep resistance. Improvements in high temperature creep resistance-particularly when creep rate is controlled by dislocation climb and glide in the gamma (γ) phase—can be achieved by adding elements which partition to the matrix phase. The γ phase of the current invention is primarily composed of the elements, molybdenum, cobalt, chromium and tungsten. Of these elemental additions molybdenum and tungsten most strongly affect the creep resistance due to their low levels of diffusivity. Modelling predictions for the effect of γ' volume fraction and creep merit index on creep resistance (predicted 1000 hr creep rupture temperature when tested at 137 MPa) are shown in FIG. 8, increasing both parameters will increase creep resistance. For a given volume fraction of γ' it is desirable to maximise the creep merit index as this is associated with an improved creep resistance.

Figure 9:
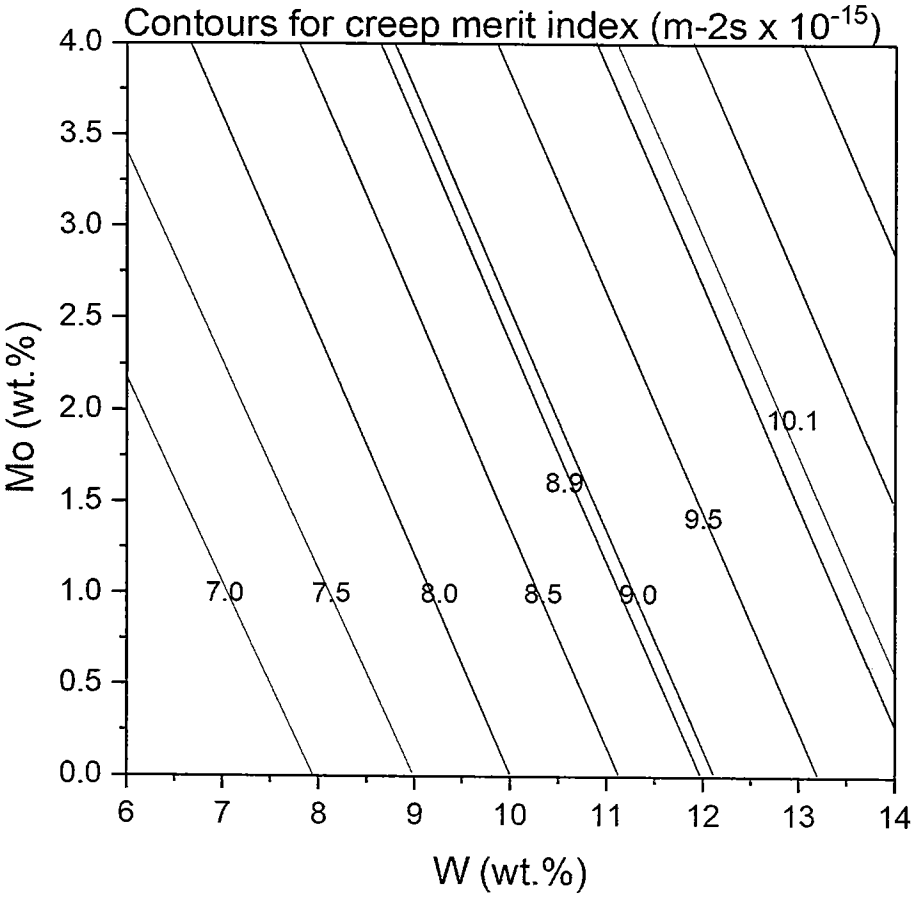
FIG. 9 is a contour plot showing the effect of molybdenum and tungsten on creep resistance (in terms of creep merit index) for alloys with volume fraction of γ' between 60-65%.

The influence of the elements molybdenum and tungsten on creep resistance is presented in FIG. 9. A creep merit index of $8.9\times10^{-15}$ m$^{-2}$s or greater was desired to produce an alloy with creep resistance substantially better than that of Mar-M246 and Mar-M247, approximately 30° C. increase creep rupture life in comparison to these alloys. More preferably a creep merit index of $10.1\times10^{-15}$ m$^{-2}$s is desired to produce alloys to provide even better creep performance, providing further increase creep rupture life in comparison to Mar-M246 and Mar-M247.

Figure 16:
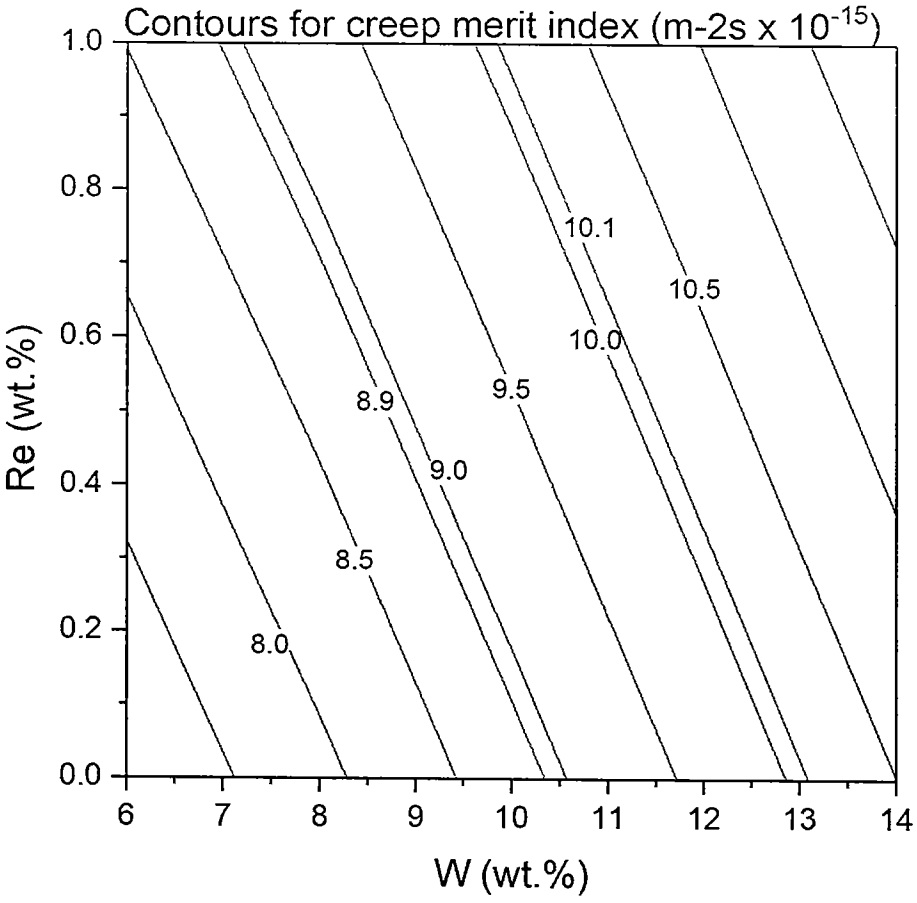
FIG. 16 is a contour plot showing substitutional effect of rhenium for tungsten on creep resistance (in terms of creep merit index) for alloys with volume fraction of γ' between 60-65%

Modelling calculation showed that for alloys with a volume fraction of γ' between 60-65% the change in creep merit index was related to the sum of the elements molybdenum and tungsten according to the formula $$f(\text{creep})=W_{Mo}+1.17(W_W+3.3W_{Re})$$

where, f(creep) is a numerical value which is greater than 13.9 for an alloy with a creep merit index of $8.9\times10^{-15}$ m$^{-2}$s or greater, preferably value of 16.5 is desired as this produces a stronger alloy with a creep merit index of $10.1\times10^{-15}$ $m^2s$ or greater. Here Re is included as it can substitute for W at a ratio of 0.33Re for 1% W. The substitutional effect of rhenium for tungsten in terms of creep merit index are demonstrated in FIG. 16. This equation along with FIG. 9 shows that an alloy with at least 1.1 wt % molybdenum has a better balance of creep and density and cost because a given level of creep resistance can be achieved with a lower amount of tungsten (which is relatively heavy) and a lower amount of rhenium (which is expensive). An even more preferred minimum amount of molybdenum id 1.3 wt %.

The maximum concentration of molybdenum in the alloy is limited to 4.0 wt %, this is described later with reference to alloy stability (FIGS. 11-15). Based on the maximum level of molybdenum a minimum of 8.4 wt. % tungsten is required in the alloy, preferably 9.3 wt. % or more tungsten, more preferably a minimum of 10.6 wt. % tungsten is present in the alloy. A most preferred level is 11.1 wt. % or more tungsten as this enhances creep resistance (FIG. 9).

The elements tantalum and tungsten play an important role in achieving an alloy with a high tensile strength and a high creep resistance. However these elements have a density which is significantly greater than nickel and therefore increase the overall density of the alloy. A target density less than or equal to CM681LC (8.9 $g/cm^3$) is required. The calculation showed that for alloys with a volume fraction of γ' between 60-65% the change in density was related to the sum of the elements tantalum and tungsten according to the formula $$f(\text{density})=W_{Ta}+0.9W_W$$

where, f(density) is a numerical value which is less than 16.2 for an alloy with a density of 8.9 $g/cm^3$, preferably a value of less than 14.7 is desired as this produces an alloy with a lower density of 8.8 $g/cm^3$ more preferably a value of less than 13.4 as this produces an alloy with a density of less than 8.7 $g/cm^3$.

Based on the minimum level of tungsten required for creep resistance (8.4 wt. %) the level of tantalum should be limited to less than 8.6 wt. %, preferably equal to or less than 7.1 wt. % to achieve a density of 8.8 $g/cm^3$.

Chromium does not greatly influence strengthening in the alloy but is added primarily increase the oxidation and corrosion resistance of the alloy. However the addition of molybdenum, tungsten for creep resistance as-well-as chromium for oxidation and corrosion resistance increase the propensity for the alloy to form unwanted TCP phases (FIG. 11-15); primarily σ, P and μ phases. In combination with a high level of tensile strength and creep resistance corrosion/oxidation equivalent to or better than CM681LC is also required. Improvements in oxidation and in particular corrosion resistance come from additions of chromium. Thus a complex trade-off between mechanical performance, oxidation/corrosion resistance and microstructural stability must be managed. The alloy of this invention requires a chromium content of greater than 6.0 wt. % ensuring that oxidation/corrosion is equivalent to or better than CM681LC. More preferably the chromium content is greater than 6.5 wt. % as this provides even better oxidation/corrosion resistance. Even more preferably chromium is present in an amount of 7.0% or more or even 7.5% or more. This increases the oxidation/corrosion resistance even further.

FIGS. 11-15 shows the effect of tungsten and chromium additions on phase stability for alloys containing different levels of molybdenum at an equilibrium temperature of 760° C., this temperature is used as TCP phases are more prevalent at these lower temperatures. A higher stability number results in an alloy which is more prone to TCP phase formation. Limiting or stopping the precipitation of TCP phase formation is beneficial as these phases lead to deterioration in material properties over time. A chromium level of greater than 6.0 wt. % is desirable in order to achieve a good level of oxidation resistance as this level of chromium will promote the formation a protective alumina oxide scale. Moreover, chromium is desirable for improving resistance to hot corrosion. A stability number target of less than 0.92 in order to ensure microstructural stability and avoid TCP formation, see prior art alloys in Table 3. More preferably a stability number target of less than 0.91 is desirable in order to ensure better microstructural stability and avoid TCP formation. From FIGS. 11-15 it is determined that for alloys with a volume fraction of γ' between 60-65% the additions of the elements molybdenum tungsten and chromium adhere to the following equation $$f(\text{stability})=W_W+W_{Re}+1.16W_{Cr}+1.7W_{Mo}$$

where f(stability) is a numerical value which must be less than 22.2 in order to achieve an alloy with a stability number of less than 0.92. Rhenium can be used in substitution for tungsten. When the minimum level of tungsten (8.4%) and minimum value of chromium (6.0 wt. %) it is determined that a maximum limit to molybdenum is 4.0 wt. %. Based on the equation for f(stability) when chromium levels are 6.0 wt. % a maximum limit of 15.2 wt. % tungsten should be included in the alloy. As molybdenum is decreased in the alloy and tungsten is added to maintain creep resistance it is possible to gain an improvement in oxidation resistance in the alloy by increasing chromium content while maintaining a desired stability. For example as molybdenum is reduces from 4.0, 3.0, 2.0, 1.0, 0.0 wt. % the maximal chromium content (while still satisfying f(creep)) increases from 6.2, 6.8, 7.3, 8.0, 8.8 respectively. Therefore it is preferable to limit the molybdenum content of the alloy to 3.0 wt. % as this improves the balance of creep resistance and oxidation resistance, more preferably molybdenum is limited to 2.0 wt. % and most preferably molybdenum is limited to 1.0 wt. %. When the alloy does not contain molybdenum the maximum concentration of chromium is limited to 8.8 wt. %.

It is preferable to limit the stability number to 0.91. To do this the numerical value for f(stability) should be less 21.0. Therefore it is preferable to limit chromium content to 7.7 wt. % (FIG. 11) as this will limit the stability number to 0.91 providing better microstructural stability. Molybdenum is preferably limited to 3.3 wt. %. Tungsten is preferably limited to 14.0 wt. % yet further to increase stability. Preferably when molybdenum is limited to 2.0 wt. % tungsten can be limited to 13.1 wt. % yet further increasing stability.

In an embodiment of the invention rhenium can be used in substitution for tungsten up to maximum of 1 wt. %. Additions are limited to 1.0 wt. % in order to maintain a reasonable alloy cost. Additions of Rhenium mean an improved balance of alloy creep resistance and oxidation corrosion resistance can be achieved whilst maintaining alloy stability. When rhenium is added at a level of 1 wt. % it is possible to achieve an increase in maximum chromium content, see FIG. 11; when the alloy is essentially free from molybdenum content and rhenium is included at 1 wt. % only 8.6 wt. % tungsten is required to achieve the desired creep resistance (f(creep)=13.9). In this case it is possible to have additions of chromium up to 11.6 wt. % and achieve a stability number of 0.92 or less. Preferably chromium additions are limited to 10.4 wt. % so that a stability number of 0.91 is achieved.

Figure 17:
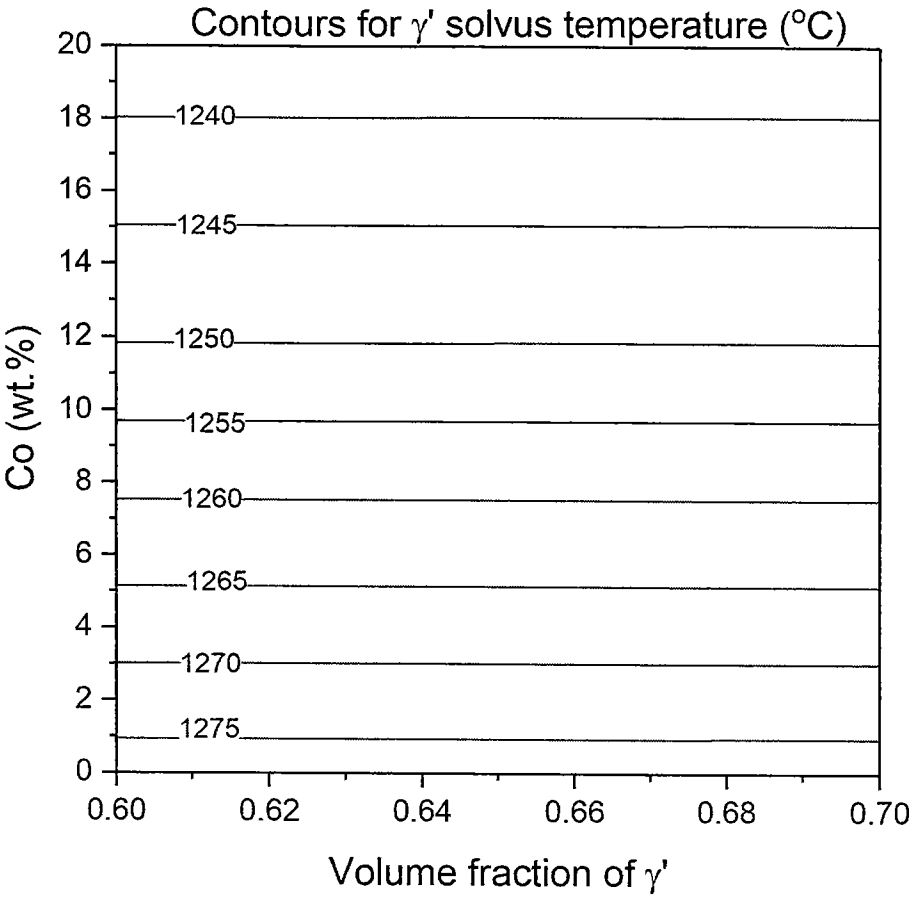
FIG. 17 is a contour plot showing the effect of cobalt on γ' solvus temperature for alloys with volume fraction of γ' between 60-65%
Figure 18:
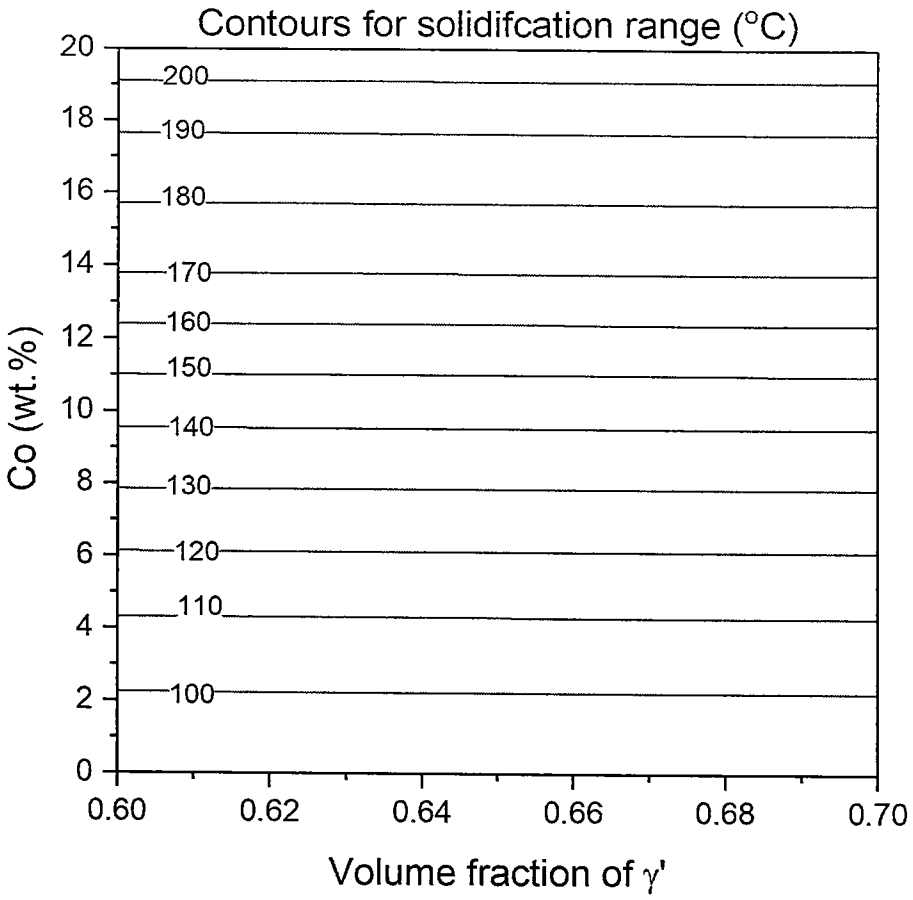
FIG. 18 is a contour plot showing the effect of cobalt on freezing temperature range for alloys with volume fraction of γ' between 60-65%

Additions of cobalt have the effect of lowering the γ' solvus temperature when γ' volume fraction is between 60 and 65% (FIG. 17). A lowering of γ' solvus temperature is desirable as it can improve the ability to perform solution heat-treatment which removes micro-segregation of elemental species occurring during solidification during the casting process. The solution heat treatment homogenises the distribution of elements and improves properties. A solution heat treatment also helps to dissolve coarse γ' precipitates which do not provide a great strengthening benefit; by rapidly cooling from solution heat-treatment temperature a fine dispersion of γ' particles can be achieved which aid improved mechanical properties. However, as cobalt content increases, the so called freezing range of the alloy is increased (FIG. 18). A high freezing range is associated with an increased level of microsegregation as the time to solidify is increased. It is desirable to reduce micro-segregation, as this reduces the need for post processing such as solution heat treatments. A target freezing range of 150° C. or less is desired, therefore cobalt up to 11.0 wt. % is allowable. A lower freezing range of about 145 C is achievable with a preferred maximum about of cobalt of 10.2 wt. % and an even lower freezing range of about 140 C is achievable with a more preferred maximum amount of cobalt of 9.6 wt. %. Preferably a balance between a low γ' solvus temperature and narrow freezing range can be achieved. Therefore it is preferable to have at least 5.1 wt. % cobalt in the alloy to achieve a solvus of 1265° C. or less to improve the solution heat treatment of the alloy. More preferably cobalt content is 7.5 wt. % or greater to reduce the solvus to less than 1260° C. or less, this further improves the ability for solution heat treatment of the alloy.

Iron behaves in a similar way to nickel and can be added as a low cost alternative to nickel. Moreover tolerance to iron additions improves the ability of the alloy to be manufactured from recycled materials. Therefore, it is preferred that iron is present in an amount of at least 0.1 wt. %. However, additions of iron up to 4.0 wt. % can be made in order to substantially reduce the cost. Preferably the additions of iron are less than 2.0 wt. % in order to reduce the propensity to form the unwanted Laves phase which degrades the mechanical properties of the alloy. Most preferably iron additions are limited to 1 wt. % as this produces an alloy which has good ability to be recycled with no loss in material performance.

Additions of carbon, boron and zirconium are required in order to provide strength to grain boundaries. This is particularly beneficial for the creep and fatigue properties of the alloy. The carbon concentrations should range between 0.02 wt. % and 0.35 wt. %. The boron concentration should range between 0.001 and 0.2 wt. %. The zirconium concentrations should range between 0.001 wt. % and 0.5 wt. %.

It is beneficial that when the alloy is produced, it is substantially free from incidental impurities. These impurities may include the elements sulphur (S), manganese (Mn) and copper (Cu). The element sulphur preferably remains below 0.003 wt. % (30 PPM in terms of mass). Manganese is an incidental impurity which is preferably limited to 0.25 wt. %. Copper (Cu) is an incidental impurity which is preferably limited to 0.5 wt. %. The presence of Sulphur above 0.003 wt. % can lead to embrittlement of the alloy and sulphur also segregates to alloy/oxide interfaces formed during oxidation. This segregation may lead to increased spallation of protective oxide scales. If the concentrations of these incidental impurities exceed the specified levels, issues surrounding product yield and deterioration of the material properties of the alloy is expected.

Additions of hafnium (Hf) of up to 2.0 wt. % are beneficial for tying up incidental impurities in the alloy and also for providing strength. In particular, hafnium is a strong carbide former it can provide additional grain boundary strengthening. More preferably hafnium additions are limited to 1.5 wt. % due to the high cost of hafnium, more preferably between 0.1 and 1.0 wt. % this provides a better balance between this grain boundary strengthening and alloy strength.

Vanadium is may be added to form strengthening carbide phases, additions of up to 1.0 wt. % can help strengthen the alloy through formation of carbide phase. Preferably, vanadium is limited to 0.5 wt. % as it can negatively influence the oxidation behaviour of the alloy. More preferably vanadium is limited to less than 0.3 wt. % and most preferably this limited to less than 0.1 wt. %.

Additions of the so called 'reactive-elements', Yttrium (Y), Lanthanum (La) and Cerium (Ce) may be beneficial up to levels of 0.1 wt. % to improve the adhesion of protective oxide layers, such as $Al_2O_3$. These reactive elements can 'mop-up' tramp elements, for example sulphur, which segregates to the alloy oxide interface weakening the bond between oxide and substrate leading to oxide spallation. Additions of Silicon (Si) up to 0.5 wt. % may be beneficial, it has been shown that additions of silicon to nickel based superalloys at levels up to 0.5 wt. % are beneficial for oxidation properties. In particular silicon segregates to the alloy/oxide interface and improves cohesion of the oxide to the substrate. This reduces spallation of the oxide, hence, improving oxidation resistance.

Based upon the description of the invention presented in this section the broad range for the invention is listed in Table 4. A preferable range is also given in Table 4 as well as a most preferable range.

TABLE 4

Compositional range in wt. % for the newly design alloy.

| Alloy (wt. %) | Al | Co | Cr | Mo | Nb | Ta | Ti | W | Re | Hf |
|---|---|---|---|---|---|---|---|---|---|---|
| Min | 5.0 | 0.0 | 6.0 | 0.0 | 0.0 | 0.6 | 0.0 | 8.4 | 0.0 | 0.0 |
| Max | 6.9 | 11.0 | 11.6 | 4.0 | 2.0 | 8.6 | 3.0 | 15.2 | 1.0 | 2.0 |
| Preferable Min | 5.5 | 5.2 | 6.0 | 1.1 | 0.0 | 3.5 | 0.0 | 10.6 | 0.0 | 0.0 |
| Preferable Max | 5.8 | 10.2 | 8.8 | 3.0 | 1.0 | 7.7 | 1.55 | 14.0 | 1.0 | 1.5 |
| Most Preferable Min | 5.7 | 7.5 | 6.0 | 1.3 | 0.0 | 5.5 | 0.0 | 11.1 | 0.0 | 0.1 |
| Most Preferable Max | 5.8 | 9.6 | 7.7 | 3.0 | 0.7 | 7.1 | 0.55 | 13.7 | 1.0 | 1.0 |

Examples of the Invention

TABLE 5

Nominal compositions in wt. % of the newly designed conventionally cast nickel-based superalloys compared with the alloys listed in Table 1.

| Alloy (wt. %) | Al | Co | Cr | Mo | Nb | Ta | Ti | W | Re | C | B | Zr | f(creep) | f(strength) | f(stable) |
|---|---|---|---|---|---|---|---|---|---|---|---|---|---|---|---|
| IN713C | 6.0 | 0.0 | 12.5 | 4.5 | 2.0 | 0.0 | 0.8 | 0.0 | 0.0 | 0.15 | 0.015 | 0.05 | 4.5 | 4.5 | 22.2 |
| MM246 | 5.5 | 10.0 | 9.0 | 2.5 | 0.0 | 1.5 | 1.5 | 10.0 | 0.0 | 0.15 | 0.015 | 0.05 | 14.2 | 4.5 | 24.7 |
| MM247 | 5.5 | 10.0 | 8.2 | 0.6 | 0.0 | 3.0 | 1.0 | 10.0 | 0.0 | 0.15 | 0.015 | 0.05 | 12.3 | 5.0 | 20.5 |
| CM681LC | 5.7 | 9.3 | 5.5 | 0.5 | 0.0 | 6.1 | 0.2 | 8.4 | 3.0 | 0.11 | 0.018 | 0.013 | 21.9 | 6.4 | 18.6 |
| Ex. T2-1 | 5.5 | 10.0 | 6.5 | 3.0 | 0.0 | 7.2 | 0.4 | 9.4 | 0.0 | 0.15 | 0.01 | 0.06 | 14.0 | 8.0 | 21.5 |
| Ex. T2-2 | 5.7 | 10.0 | 7.0 | 1.5 | 0.0 | 6.6 | 0.0 | 10.8 | 0.0 | 0.15 | 0.01 | 0.06 | 14.1 | 6.6 | 20.3 |
| Ex. T2-3 | 5.5 | 10.0 | 6.0 | 1.3 | 0.0 | 4.4 | 1.1 | 12.8 | 0.0 | 0.15 | 0.01 | 0.06 | 16.3 | 6.6 | 22.0 |
| Ex. T2-4 | 5.5 | 10.0 | 8.0 | 2.0 | 0.0 | 7.2 | 0.4 | 9.3 | 1.0 | 0.15 | 0.01 | 0.06 | 16.9 | 8.0 | 19.7 |

TABLE 6

Calculated phase fractions and merit indices made with the "Alloys-by-Design" software. Results for nickel-based superalloys used for producing a turbine wheel within an exhaust gas turbocharger device Table 1 and the nominal composition of the new alloys listed in Table 5.

| Alloy (wt. %) | T | Creep Merit Index ($m^{-2}s \times 10^{-15}$) | Density ($g/cm^3$) | Cost ($/kg) | γ/γ' Misfit (%) | Strength Merit Index (Mpa) | Md (eV) |
|---|---|---|---|---|---|---|---|
| IN713C | 0.54 | 2.9 | 8 | 16 | −0.40 | 1133 | 0.92 |
| MM246 | 0.56 | 7.3 | 8.5 | 30 | −0.35 | 1246 | 0.93 |
| MM247 | 0.58 | 7.5 | 8.6 | 50 | −0.16 | 1279 | 0.91 |
| CM681LC | 0.62 | 14.3 | 8.9 | 128 | −0.25 | 1396 | 0.91 |
| Example T2-1 | 0.64 | 9.3 | 8.8 | 66 | −0.51 | 1470 | 0.92 |
| Example T2-2 | 0.63 | 9.0 | 8.9 | 64 | −0.32 | 1405 | 0.92 |
| Example T2-3 | 0.66 | 9.9 | 8.8 | 56 | −0.49 | 1402 | 0.92 |
| Example T2-4 | 0.64 | 11.9 | 8.9 | 88 | −0.64 | 1478 | 0.92 |

The alloys of Examples T2-1 T2-4 are designed to achieve higher temperature performance that is better than Mar-M246 and Mar-M247 this is resulting from a higher γ' volume fraction, higher strength merit index and a higher creep merit index. The alloys have properties which are approaching the high temperature performance of CM681LC with a reduction in alloy cost and an acceptable microstructural stability. In particular a high level of creep performance is achieved in combination with a reduction in alloy cost while maintaining other key material properties including oxidation/corrosion resistance, microstructural stability and alloy density

The invention claimed is:

1. A nickel-based alloy composition consisting, in weight percent, of: between 5.0% and 6.9% aluminium, between 0.0% and 11.0% cobalt, between 6.0% and 8.8% chromium, between 0.0% and 4.0% molybdenum, between 0.0% and 2.0% niobium, between 0.6 and 8.6% tantalum, between 0.0% and 3.0% titanium, between 8.4% and 15.2% tungsten, between 0.02 wt. % and 0.35 wt. % carbon, between 0.001 and 0.2 wt. % boron, between 0.001 wt. % and 0.5 wt. %, zirconium, between 0.0 and 0.5% silicon, between 0.0 and 0.1% yttrium, between 0.0 and 0.1% lanthanum, between 0.0 and 0.1% cerium, between 0.0 and 0.003% sulphur, between 0.0 and 0.25% manganese, between 0.0 and 0.5% copper, between 0.0 and 2.0% hafnium, between 0.0 and 1.0% vanadium, between 0.0 and 4.0% iron, between 0.0 and 1.0% rhenium, the balance being nickel and incidental impurities, wherein the following equations are satisfied in which $W_{Nb}$, $W_{Ta}$, $W_{Ti}$, $W_{Cr}$, $W_{Mo}$, $W_W$ and $W_{Re}$ are the weight percent of niobium, tantalum, titanium, chromium, molybdenum, tungsten and rhenium in the alloy respectively $$6.6 \leq 2W_{Ti}+W_{Ta}+1.44W_{Nb}$$

$$21.0 \geq W_W+W_{Re}+1.16W_{Cr}+1.7W_{Mo}$$

$$13.9 \leq W_{Mo}+1.17(W_W+3.3W_{Re})$$

2. The nickel-based alloy composition according to claim 1, wherein the following equation is satisfied in which $W_{Al}$, $W_{Ti}$ $W_{Nb}$ and $W_{Ta}$ are the weight percent of aluminium, titanium, niobium and tantalum in the alloy respectively $$6.5 \leq W_{Al}+0.5W_{Ti}+0.3W_{Nb}+0.15W_{Ta} \leq 6.9$$

3. The nickel-based alloy composition according to claim 1, wherein the following equation is satisfied in which $W_{Ti}$, $W_{Ta}$ and $W_{Nb}$ are the weight percent of titanium, tantalum and niobium in the alloy respectively $$7.4 \leq 2W_{Ti}+W_{Ta}+1.44W_{Nb}.$$

4. The nickel-based alloy composition of claim 1, consisting of, in weight percent, of 7.0% or more chromium.

5. The nickel-based alloy composition of claim 1, consisting of, in weight percent, of 7.7% or less chromium.

6. The nickel-based alloy composition of claim 1, consisting of, in weight percent, of 1.4% or more tantalum.

7. The nickel-based alloy composition of claim 1, consisting of, in weight percent, of 4.0% or less molybdenum.

8. The nickel-based alloy composition of claim 1, consisting of, in weight percent, of 0.1% or more hafnium.

9. The nickel-based alloy composition of claim 1, consisting of, in weight percent, of 14.0% or less tungsten.

10. The nickel-based alloy composition of claim 1, consisting of, in weight percent, of 1.5% or less hafnium.

11. The nickel-based alloy composition of claim 1, consisting of, in weight percent, of 9.3% or more tungsten.

12. The nickel-based alloy composition of claim 1, consisting, in weight percent, of 5.4% or more aluminium.

13. The nickel-based alloy composition of claim 1, consisting of, in weight percent, of 1.0% or more iron.

14. The nickel-based alloy composition according to claim 1, wherein the following equation is satisfied in which $W_{Ta}$ and $W_W$ are the weight percent of tantalum and tungsten in the alloy respectively: $W_{Ta}+0.9W_W \leq 16.2$.

15. The nickel-based alloy composition of claim 1, having 1.0 wt % or less niobium.

16. The nickel-based alloy composition of claim 1, having 0.35 wt % or more titanium.

17. The nickel-based alloy composition of claim 1, having 5.1 wt % or more cobalt.

18. The nickel-based alloy composition of claim 1, having 10.2 wt % or less cobalt.

19. The nickel-based alloy composition of claim 1, having 1.1 wt % or more molybdenum.

* * * * *